US012582196B2

(12) United States Patent
Anceresi et al.

(10) Patent No.: US 12,582,196 B2
(45) Date of Patent: Mar. 24, 2026

(54) ARTICLE OF FOOTWEAR INCLUDING A SOLE STRUCTURE

(71) Applicant: NIKE, Inc., Beaverton, OR (US)

(72) Inventors: Giorgio Anceresi, Portland, OR (US); Fidencio Campos, II, Dallas, OR (US); Roger P. Murphy, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/754,540

(22) Filed: Jun. 26, 2024

(65) Prior Publication Data

US 2025/0000207 A1 Jan. 2, 2025

Related U.S. Application Data

(60) Provisional application No. 63/511,406, filed on Jun. 30, 2023.

(51) Int. Cl.
*A43B 13/20* (2006.01)
*A43B 13/18* (2006.01)

(52) U.S. Cl.
CPC ..... *A43B 13/20* (2013.01); *A43B 13/186* (2013.01)

(58) Field of Classification Search
CPC ..... A43B 13/20; A43B 13/203; A43B 13/206
USPC ..... 36/29
See application file for complete search history.

(56) References Cited

U.S. PATENT DOCUMENTS 4,017,931 A 4/1977 Golden
5,131,174 A * 7/1992 Drew ..... A43B 21/28 36/35 B
D349,804 S * 8/1994 Passke ..... D2/977
5,353,459 A * 10/1994 Potter ..... A43B 17/03 36/71
5,625,964 A 5/1997 Lyden et al.
5,771,606 A 6/1998 Litchfield et al.
6,253,466 B1 * 7/2001 Harmon-Weiss .... A43B 13/189 36/35 R
6,453,577 B1 * 9/2002 Litchfield ..... A43B 13/203 36/35 B
D549,433 S * 8/2007 Schindler ..... D2/961
9,119,439 B2 * 9/2015 Brandt ..... B29C 51/105
9,609,913 B2 * 4/2017 Bates ..... A43B 13/203
(Continued)

OTHER PUBLICATIONS

International Search Report and Written Opinion, PCT/US2024/035520, mailed Sep. 25, 2024.

*Primary Examiner* — Ted Kavanaugh
(74) *Attorney, Agent, or Firm* — BOOKOFF MCANDREWS PLLC

(57) ABSTRACT

A sole structure having a lateral side and a medial side opposite the lateral side. The sole structure has an outsole layer, a first support element including first recesses, a second support element coupled to the outsole layer and including second recesses, and a cushioning element disposed between the first support element and the second support element. The cushioning element has a plurality of pockets and a central pod. A first subset of the plurality of pockets are disposed on the lateral side, a second subset of the plurality of pockets are disposed on the medial side, and a rear pocket of the plurality of pockets extends from the lateral side and the medial side. The first subset, the second subset, and the rear pocket are separated from the central pod by a web area. The plurality of pockets are at least partially enclosed by the first and second recesses.

20 Claims, 18 Drawing Sheets

(56) References Cited

U.S. PATENT DOCUMENTS

| | | | | |
|---|---|---|---|---|
| 10,555,580 | B2 * | 2/2020 | Peyton | A43B 13/04 |
| 2019/0261739 | A1 * | 8/2019 | Taylor | A43B 13/206 |
| 2023/0189925 | A1 * | 6/2023 | Andreasen | A43B 13/189<br>36/29 |

* cited by examiner

ARTICLE OF FOOTWEAR INCLUDING A SOLE STRUCTURE

CROSS-REFERENCE TO RELATED APPLICATION

This application claims priority under 35 U.S.C. §119(e) to Provisional U.S. Patent Application No. 63/511,406, filed Jun. 30, 2023, the disclosure of which is hereby incorporated by reference in its entirety.

FIELD

The present disclosure relates generally to articles of footwear including sole structures and more particularly to sole structures incorporating a fluid-filled bladder.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymeric foam material that compresses resiliently under an applied load to cushion the foot by attenuating ground-reaction forces. The midsole may additionally be coupled to or alternatively incorporate a fluid-filled bladder to increase the durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles coupled to fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

BRIEF DESCRIPTION OF THE DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
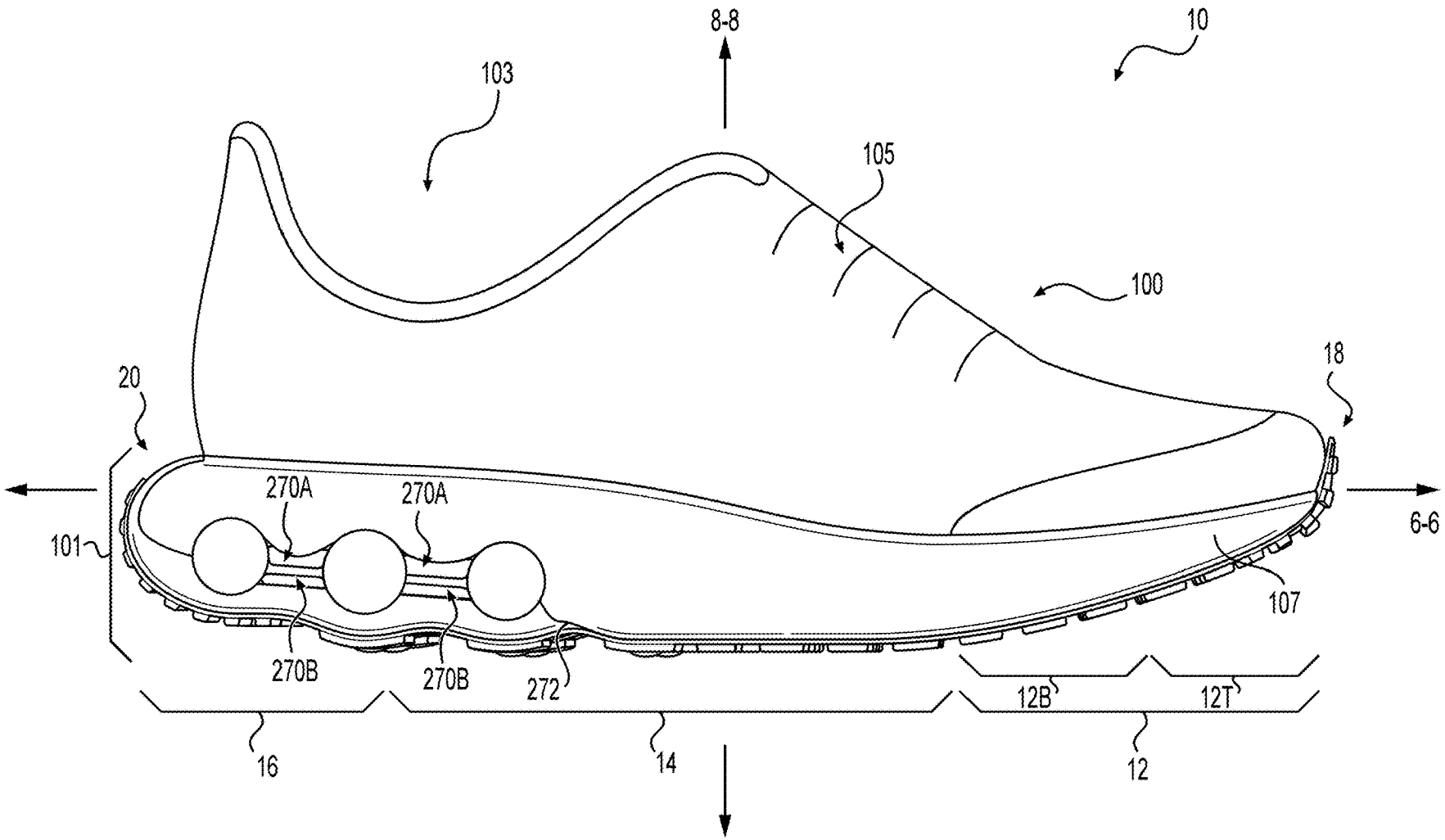
FIG. 1 is a side view of an article of footwear.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional and/or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In the discussion that follows, terms "about," "approximately," "substantially," and the like, when used in describing a numerical value, denote a variation of +/−10% of that value, unless specified otherwise.

The present disclosure is directed to an article of footwear, such as an article of footwear 10 shown in FIG. 1, that provides underfoot cushioning and responsiveness during use. FIG. 1 depicts an article of footwear 10 that further provides a balance of comfort and stability.

As shown in FIG. 1, footwear 10 includes a sole structure 101 and an upper 100 attached to the sole structure 101. The article of footwear 10 is divided into a forefoot region 12, a mid-foot region 14, and a heel region 16. The heel region 16 includes gaps 270A and 270B and a contact area 272, which will be described in further detail below. The forefoot region 12 includes a toe portion 12T corresponding to the phalanges of the foot, and a ball portion 12B corresponding to a metatarsophalangeal (MTP) joint. The mid-foot region 14 corresponds with an arch area of the foot, and the heel region 16 corresponds with rear portions of the foot, including a calcaneus bone. The footwear 10 further includes an anterior end 18 proximate to a forward-most point of the forefoot region 12, and a posterior end 20 proximate to a rearward-most point of the heel region 16. For ease of discussion, the footwear 10 is discussed with reference to a longitudinal axis 6-6, a medial-lateral axis AML (shown in FIG. 3B), and a vertical axis 8-8, where the longitudinal axis 6-6, the medial-lateral axis AML, and the vertical axis 8-8 are perpendicular to each other. The longitudinal axis 6-6 of the footwear 10 extends along a length of the footwear 10 from the anterior end 18 to the posterior end 20, and generally divides the footwear 10 into a medial side 22 and a lateral side 24 (shown in FIG. 8). The medial-lateral axis AML extends from medial side 22 to lateral side 24. Accordingly, the medial side 22 and the lateral side 24 respectively correspond with opposite sides of the footwear 10 and extend from the anterior end 18 to the posterior end 20. The vertical axis 8-8 extends from a bottom (i.e., ground-contacting portion) of the footwear 10 to a top of the footwear 10.

Still referring to FIG. 1, the upper 100 includes interior surfaces that define an interior void configured to receive and secure a foot for support on sole structure 101. The upper 100 may be formed from one or more materials that are stitched or adhesively bonded together to form the interior void. Suitable materials of the upper include, but are not limited to, mesh, textiles, foam, leather, and synthetic leather. The materials are configured and located to impart properties of durability, air-permeability, wear-resistance, flexibility, and/or comfort.

In some examples, the upper 100 includes a strobel (not shown) having a bottom surface opposing the sole structure 101 and an opposing top surface defining a footbed of the interior void. Stitching or adhesives secure the strobel to the upper 100. The footbed is contoured to conform to a profile of the bottom surface (e.g., plantar) of the foot. The upper 100 may incorporate additional layers such as an insole or sockliner (not shown) that are disposed upon the strobel and reside within the interior void of the upper 100 to receive a plantar surface of the foot to enhance the comfort of the article of footwear 10. An ankle opening 103 in the heel region 16 provides access to the interior void. For example, the ankle opening 103 receives a foot to secure the foot within the void and facilitate entry and removal of the foot from and to the interior void.

In some examples, one or more fasteners 105 extend along the upper 100 to adjust a fit of the interior void around the foot and to accommodate entry and removal of the foot therefrom. The fasteners 105 may include laces, straps, cords, hook-and-loop, or any other suitable type of fastener. The upper 100 can include a tongue portion (not shown) that extends between the interior void and the fasteners.

Figure 2:
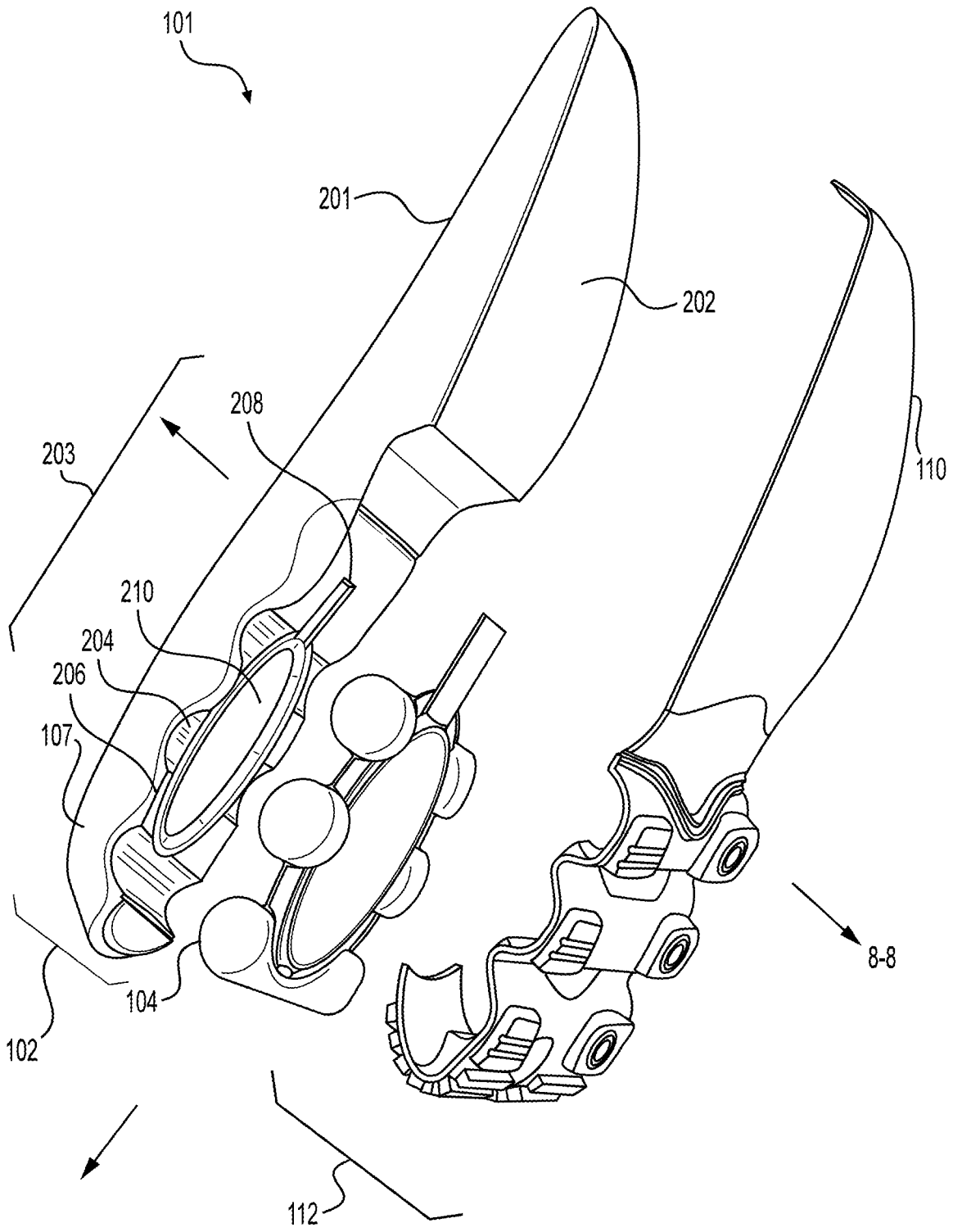
FIG. 2 is an exploded perspective view of a sole structure of the article of footwear of FIG. 1.

With reference to FIG. 2, the sole structure 101 includes a midsole 102, which includes a first support element 107. In some examples, the midsole 102 is of a unitary construction. The sole structure 101 further includes a cushioning element 104, and an outsole 112. The outsole 112 includes a second support element 106 and an outsole layer 110. The outsole layer 110 extends from the mid-foot region 14 to the forefoot region 12. The second support element 106 extends from the heel region 16 to the mid-foot region 14. The posterior most end of the outsole layer 110 curves upward toward the upper 100. Portions of the outsole 112 are configured to provide a ground-engaging surface of the article of footwear 10 that directly contacts the ground. The sole structure 101 is configured to provide cushioning characteristics to the article of footwear 10.

Still referring to FIG. 2, first support element 107 includes a top surface 201 and a bottom surface 202. Bottom surface 202 includes a plurality of recesses 204, a plurality of mounds 206, a receiving portion 208, and a receptacle 210. The recesses 204, the mounds 206, the receiving portion 208, and the receptacle 210 together form an interface region 203. The plurality of recesses 204 and the plurality of mounds 206 alternate with one another along the longitudinal axis 6-6 to form an undulating path along the bottom surface 202 of the first support element 107. The plurality of recesses 204 and the plurality of mounds 206 bound lateral and medial sides of the receptacle 210. The receiving portion 208 bounds an anterior most portion of the receptacle 210. One recess of the plurality of recesses 204 bounds the posterior most portion of the receptacle 210. The undulating path exhibits a plurality of peaks and valleys when viewed from an exterior of the article of footwear 10. The plurality of recesses 204 correspond to the peaks of the undulating path and the plurality of mounds 206 correspond to the valleys of the undulating path. The receptacle 210 is substantially ovular, but may be any other suitable shape including, e.g., rectangular, triangular, diamond, or the like. As shown, each of the plurality of mounds 206 has a rounded shape, but may include any other shape (e.g., rectangular, triangular, irregular, jagged or the like). Some of the plurality of recesses 204 and the plurality of mounds 206 are present in the heel region 16, while some of the plurality of recesses 204 and the plurality of mounds 206 are present in the mid-foot region 14. As shown, the plurality of recesses 204 and the plurality of mounds 206 span the entirety (or substantial entirety) of the length of the heel region 16, and only a portion of the mid-foot region 14. However, recesses 204 and mounds 206 could span the entirety of mid-foot region 14 and some or all of the forefoot region 12.

The receiving portion 208 is a cavity within the bottom surface 202 positioned in the mid-foot region 14. The receiving portion 208 has a substantially rectangular shape, but could have another shape (e.g., square, triangular, ovular, or etc.). Receiving portion 208 provides access for removal of the cushioning element 104. Additionally, receiving portion 208 receives a portion of the cushioning element 104, such as, e.g., an inflation tube 245 of cushioning element 104. The anterior of the bottom surface 202 extending from the mid-foot region 14 to the forefoot region 16 is free of and excludes the plurality of recesses 204, the plurality of mounds 206, and the receiving portion 208. In other words, the portion of the bottom surface 202 extending from a portion of the mid-foot region 14 to the forefoot region 16 may be a substantially smooth surface. In other embodiments, the portion of the bottom surface 202 extending from a portion of the mid-foot region 14 to the forefoot region 16 could include the recesses 204 and/or mounds 206.

First support element 107 includes a support material suitable for providing a desired cushioning characteristic to the article of footwear 10. For example, first support element 107 may consist of or comprise a polymeric support material. The polymeric support material may be a foamed polymeric support material, as described in greater detail below.

Figure 3A:
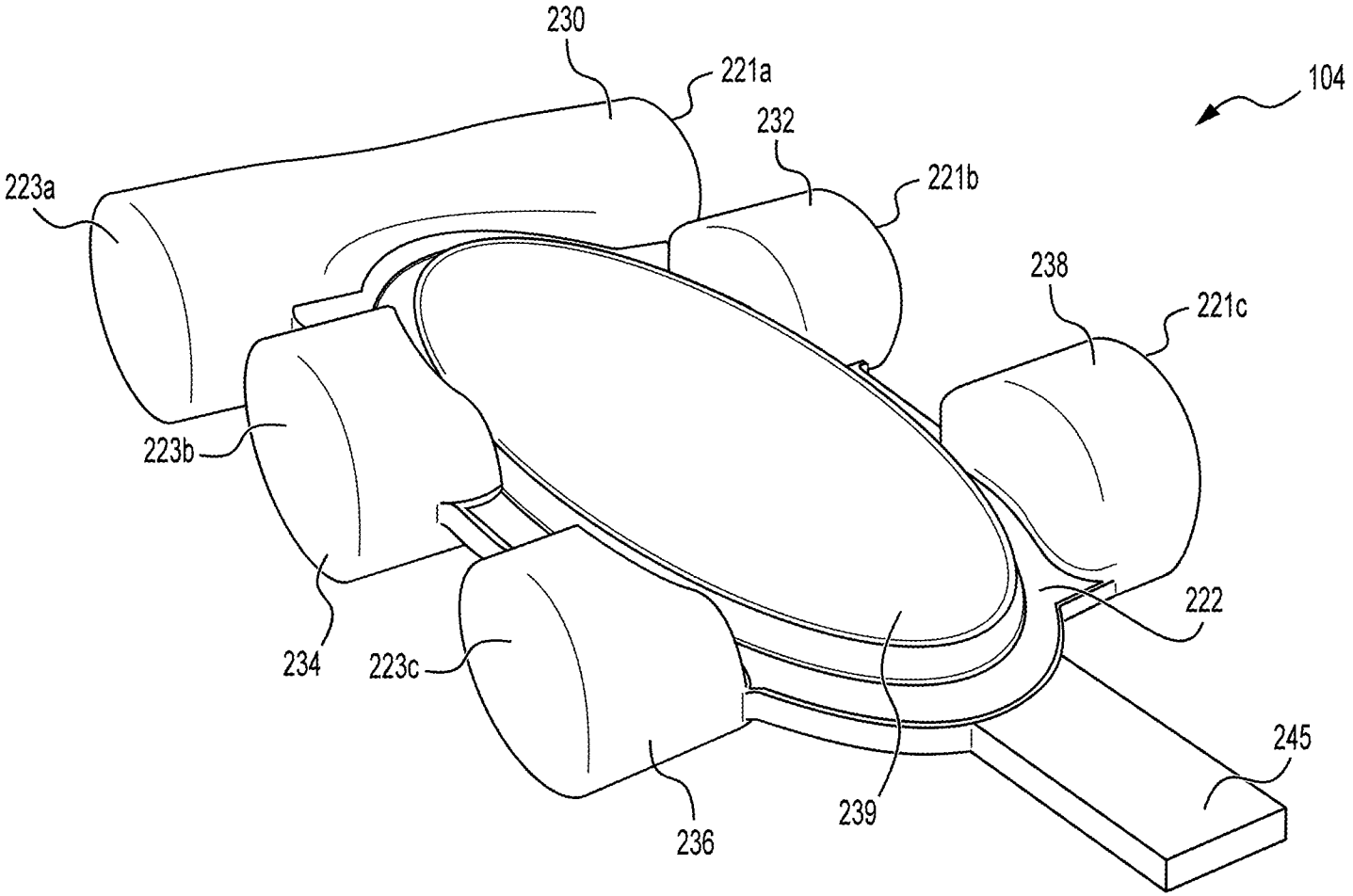
FIG. 3A is a perspective view of a cushioning element of the sole structure of FIG. 2.

Referring to FIG. 3A, the cushioning element 104 is a fluid-filled cushioning element, such as an airbag or bladder. The cushioning element 104 is defined by pockets 230, 232, 234, 236, and 238, central pod 239, distinct web area 222, and a plurality of channels 224*a*, 224*b*, 224*c*, 224*d*, and 224*e* (shown in FIG. 3C). Web area 222 extends between the central pod 239 and each of the respective pockets 230, 232, 234, 236, and/or 238. Web area 222 also extends between respective adjacent pockets of the pockets 230, 232, 234, 236, and/or 238. The pockets 230, 232, 234, 236, and/or 238 and central pod 239 are shown in a fluid-filled state (e.g., FIG. 3A). The pockets 230, 232, 234, 236, 238 and/or central pod 239 are filled via inflation tube 245 to include any suitable fluid, such as a gas or liquid. In an example, the gas includes air, nitrogen gas ($N_2$), inert gasses, or any other suitable gas. In other examples, the pockets 230, 232, 234, 236, 238 and/or central pod 239 include other media, such as pellets, beads, ground recycled material, and the like (e.g., foamed beads and/or rubber beads). In an example, the fluid provided to pockets 230, 232, 234, 236, and 238 as well as central pod 239 are at atmospheric pressure such that the pockets 230, 232, 234, 236, and 238 and central pod 239 are not pressurized and each contains a volume of fluid that exerts atmospheric pressure and/or maintains the cushioning element 104 at atmospheric pressure. It is contemplated that pockets 230, 232, 234, 236, and/or 238 may be cylindrical, triangular, pentagonal, cubed, or the like.

In some examples, a geometry (e.g., thicknesses, widths, and lengths) of the pockets 230, 232, 234, 236, 238 and/or central pod 239 defines the cushioning element 104. For example, each of the web area 222, the channels 224*a*, 224*b*, 224*c*, 224*d*, and/or 224*e*, pockets 230, 232, 234, 236, and/or 238, and/or central pod 239 seal the fluid (e.g., air) within an interior void 226 (shown in FIG. 4A) of each of pockets 230, 232, 234, 236, and 238 and central pod 239. Thus, the pockets 230, 232, 234, 236, 238 and/or central pod 239 are associated with an area of the cushioning element 104 where interior surfaces of the cushioning element 104 are not joined together and, thus, are separated from one another. Each of pockets 230, 232, 234, 236, and 238 and central pod 239 are fluidly isolated from one another. In other examples, each of pockets 230, 232, 234, 236, and 238 and central pod 239 may be in fluid communication with one another. In other examples, some of pockets 230, 232, 234, 236, and 238 and central pod 239 may be in fluid communication with one another while others of pockets 230, 232, 234, 236, and 238 and central pod 239 are not in fluid communication with one another.

Still referring to FIG. 3A, the pocket 230 has a medial face 221*a* and a lateral face 223*a*. The medial face 221*a* is a substantially rounded surface of the pocket 230 on the medial side 22 of the article of footwear 10. The lateral face 223*a* also is a substantially rounded surface of the pocket 230 on the lateral side 24 of the article of footwear 10. The lateral face 223*a* is substantially similar to the medial face 221*a*, such that a dimension of the lateral face 223*a* is substantially similar to a dimension of the medial face 221*a*. In other embodiments, the lateral face 223*a* is different from the medial face 221*a*. Pocket 232 includes a medial face 221*b* and pocket 238 includes a medial face 221*c*. Pocket 234 includes a lateral face 223*b* and pocket 236 includes a lateral face 223*c*. The medial faces 221*b* and 221*c* are substantially similar to the medial face 221*a*, such that a dimension of the medial faces 221*b* and 221*c* are substantially similar to the dimension of the medial face 221*a*. In other embodiments, the medial faces 221*b* and 221*c* are different from the medial face 221*a*. In alternative examples, medial face 221*a* is smaller than medial faces 221*b* and 221*c*. In alternative examples, medial face 221*a* is larger than medial faces 221*b* and 221*c*. In alternative examples, medial face 221*b* is smaller than medial faces 221*a* and 221*c*. In alternative examples, medial face 221*b* is larger than medial faces 221*a* and 221*c*. In alternative examples, medial face 221*c* is smaller than medial faces 221*a* and 221*b*. In alternative examples, medial face 221*c* is larger than medial faces 221*a* and 221*b*. The lateral faces 223*b* and 223*c* are substantially similar to the medial face 223*a*, such that a dimension of the 223*b* and 223*c* are substantially similar to the dimension of the medial face 223*a*. In other embodiments, the lateral faces 223*b* and 223*c* are different from the lateral face 223*a*. In alternative examples, lateral face 223*a* is smaller than lateral faces 223*b* and 223*c*. In alternative examples, lateral face 223*a* is larger than medial faces 223*b* and 223*c*. In alternative examples, lateral face 223*b* is smaller than lateral faces 223*a* and 223*c*. In alternative examples, lateral face 223*b* is larger than medial faces 223*a* and 223*c*. In alternative examples, lateral face 223*c* is smaller than lateral faces 223*a* and 223*b*. In alternative examples, lateral face 223*c* is larger than medial faces 223*a* and 223*b*.

In an example, the total number of pockets 230, 232, 234, 236, and 238 is five. It is contemplated that the number of pockets may be one, two, three, four, five or more to provide a desired cushioning characteristic. In the example, the pockets 230, 232, 234, 236, and 238 may be arranged such that there is a rear most pocket 230, a central medial pocket 232, a central lateral pocket 234, a front most lateral pocket 236, and a front most medial pocket 238. The widths of each of pockets 230, 232, 234, 236, and 238 extends parallel to the medial-lateral axis AML.

Figure 3B:
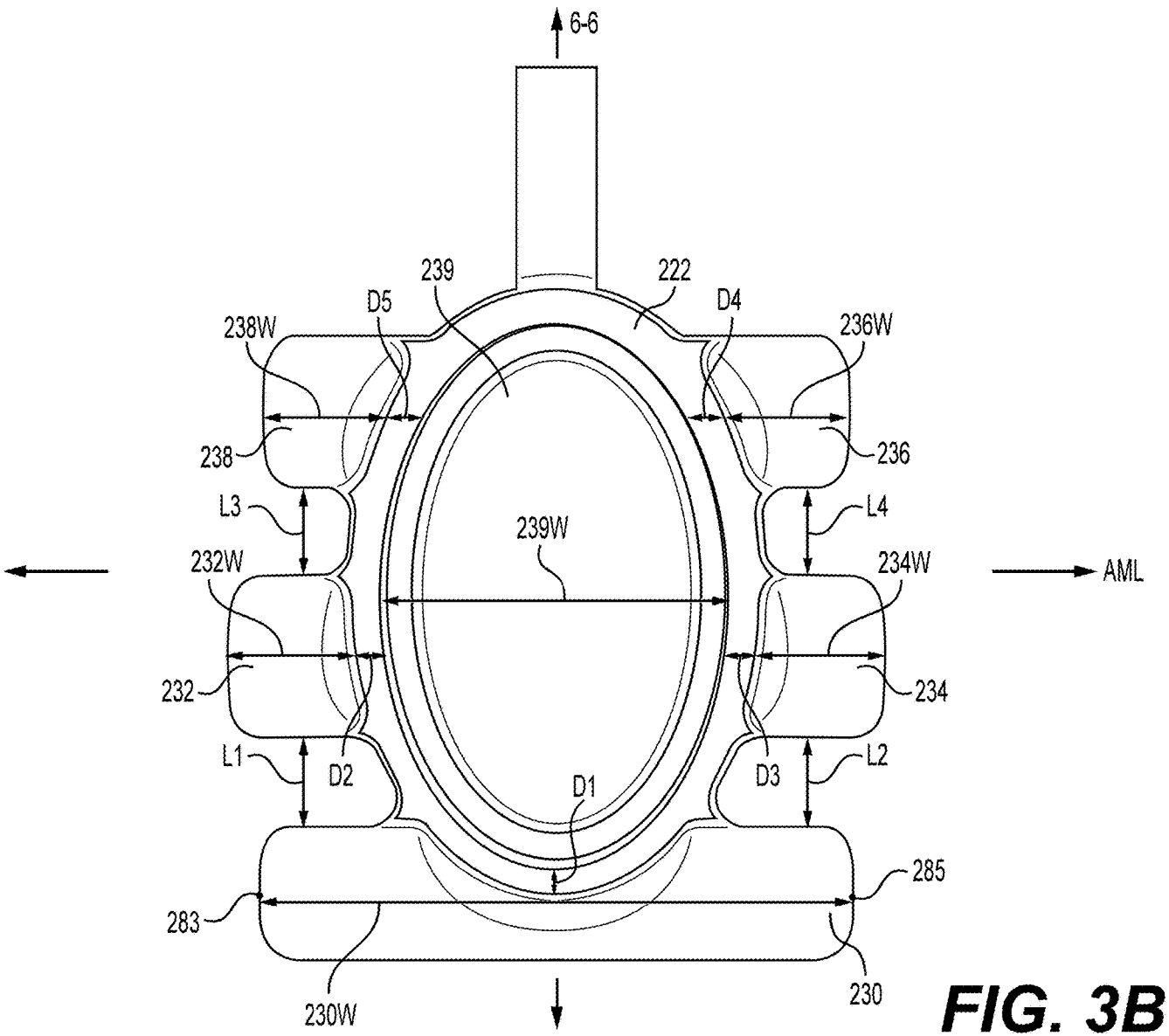
FIG. 3B is a top view of the cushioning element of FIG. 3A.

Referring to FIG. 3B, a distance D1 is disposed between the central pod 239 and the pocket 230. Distance D1 extends between opposing exterior surfaces of the central pod 239 and the pocket 230. Distance D1 may be, for example, approximately 5 mm. A distance D2 is disposed between the central pod 239 and the pocket 232. Distance D2 extends between opposing exterior surfaces of the central pod 239 and the pocket 232. Distance D2 may be, for example, approximately 5 mm. A distance D3 is disposed between the central pod 239 and the pocket 234. Distance D3 extends between opposing exterior surfaces of the central pod 239 and the pocket 234. Distance D3 may be, for example, approximately 5 mm. A distance D4 is disposed between the central pod 239 and the pocket 236. Distance D4 extends between opposing exterior surfaces of the central pod 239 and the pocket 236. Distance D4 may be, for example, approximately 5 mm. A distance D5 is disposed between the central pod 239 and the pocket 238. Distance D5 extends between opposing exterior surfaces of the central pod 239 and the pocket 238. Distance D5 may be, for example, approximately 5 mm. In an example, each of distances D1, D2, D3, D4, and D5 are the same and form a uniform area between the central pod 239 and each of the pockets 230, 232, 234, 236, and 238. In other examples, any one of distances D1, D2, D3, D4, and D5 may be different from one another forming a nonuniform area between the central pod 239 and each of pockets 230, 232, 234, 236, and 238.

Pocket 230 extends from the medial side 22 to the lateral side 24 corresponding to a width (e.g., in the medial-lateral direction) of the pocket 230. The width of pocket 230 is measured from a medial center point 283 on its medial face 221*a* to a lateral center point 285 on its lateral face 223*a*. Center point 283 is disposed centrally on medial face 221*a* between a first surface (e.g. a top surface facing the upper 100) of the pocket 230 and a second surface (e.g. a bottom surface facing a ground surface) of the pocket 230. Center point 283 is disposed halfway along a longitudinal dimension of the pocket 230. Center point 285 is disposed centrally on lateral face 223*a* between a first surface (e.g. a top surface facing the upper 100) of the pocket 230 and a second surface (e.g. a bottom surface facing a ground surface) of the pocket 230. Center point 285 is disposed halfway along a longitudinal dimension of the pocket 230. The width of pocket 230 is measured using a centerline extending along the medial-lateral axis AML. In addition to or in place of using the centerline, the width can be measured using any line extending between the medial face 221*a* and the lateral face 223*a* and parallel to the medial-lateral axis AML. The lines extending between the medial face 221*a* and the lateral face 223*a* and parallel to the medial-lateral axis AML of pocket 230 include a value that can be represented as an average width. The average width is the average of the values attained via the lines taken between the medial face 221*a* and the lateral face 223*a* and parallel to the medial-lateral axis AML. Additionally or alternatively, the width can be measured between a longitudinal center between the medial face 221*a* and the lateral face 223*a*.

Pockets 232, 234, 236, and 238 each extend from an area on an outer edge of the web area 222 adjacent to the given pocket to the respective medial or lateral face of the given pocket 232, 234, 236, and 238 corresponding to a width (e.g., in the medial-lateral direction) of the pockets 232, 234, 236, and 238. The width can be measured using any line extending between the outer edge of the web area 222 and the face of the given pocket 232, 234, 236, and 238. The lines extending between the outer edge of the web area 222 and the face of the given pocket 232, 234, 236, and 238 and parallel to the medial-lateral axis AML includes a value that can be represented as an average width. The average width is the average of the values attained via the lines taken between the outer edge of the web area 222 and the face of the given pocket 232, 234, 236, and 238 and parallel to the medial-lateral axis AML. Additionally or alternatively, the width can be measured between a longitudinal center between the outer edge of the web area 222 and the respective medial or lateral face of the given pocket 232, 234, 236, and 238.

Pocket 230 has a width 230W. Pocket 232 has a width 232W. Pocket 234 has a width 234W. Pocket 236 has a width 236W. Pocket 238 has a width 238W. The width of a given pocket 230, 232, 234, 236, and 238 is represented as an average width. The width 230W may range from about 0.5 to about 15 cm. The width 230W may range from about 2 cm to about 12 cm. The width 230W may range from about 3 cm to about 10 cm. In an example, width 230W is about 5 cm. The widths 232W, 234W, 236W, 238W may range from about 0.5 to about 8 cm. The widths 232W, 234W, 236W, 238W may range from about 0.75 cm to about 6 cm. The widths 232W, 234W, 236W, 238W may range from about 1 cm to about 5 cm. In an example, width 232W is about 1 cm. In an example, width 234W is about 1 cm. In an exemplary embodiment, width 236W is about 0.8 cm. In an example, width 238W is about 0.8 cm.

In an example, width 230W is greater than each of widths 232W, 234W, 236W, and 238W. In one example, the widths 232W and 234W are substantially similar or the same. In one example, the widths 236W and 238W are substantially similar or the same. In one example, the widths 232W and 234W may vary from one width to another. In one example, the widths 236W and 238W may vary from one width to another. The central medial pocket 232 may be greater in width than the front most lateral pocket 236 and the front most medial pocket 238. The central lateral pocket 234 may be greater in width than the front most lateral pocket 236 and the front most medial pocket 238. In other examples, each of pockets 232, 234, 236, and 238 may have substantially similar widths. It is contemplated that any one of pockets 232, 234, 236, or 238 may have a width that varies from one or more other pockets. It is also contemplated that pockets 232, 234, 236, and/or 238 may have substantially similar widths. Pockets 230, 232, 234, 236, and/or 238, as shown in the example in FIG. 3A, aid transitions during walking by rolling the foot from the largest pocket 230 through the pockets 232, 234, 236, 238 and/or the central pod 239. The pockets 230, 232, 234, 236, and 238 additionally provided a desired form of underfoot cushioning.

Central pod 239 extends between inner edges of the web area 222 corresponding to a width (e.g., in a medial-lateral direction) of the central pod 239. The width of central pod 239 is measured between inner edges of the web area 222. The width of the central pod 239 is measured through a longitudinal center of the central pod 239. The width of central pod 239 is measured between inner edges of the web area 222 disposed adjacent to the central pod 239 using a centerline extending parallel to the medial-lateral axis AML. In addition to or in place of using the centerline, the width can be measured using any line extending between inner edges of the web area 222 and parallel to the medial-lateral axis AML. The lines extending between the inner edges of the web area 222 and parallel to the medial-lateral axis AML of central pod 239 include a value that can be represented as an average width. The average width is the average of the values attained via the lines taken between the inner edges of the web area 222 and parallel to the medial-lateral axis AML.

Central pod 239 has a width 239W. The width 239W may range from about 2 to about 15 cm. The width 239W may range from about 2 cm to about 12 cm. The width 239W may range from about 3 cm to about 10 cm. In an example, width 239W is about 5 cm.

An outer surface of the pocket 230 is spaced apart from an outer surface of the pocket 232 by a first length L1. An outer surface of the pocket 234 is spaced apart from an outer surface of the pocket 230 by a second length L2. An outer surface of the pocket 232 is spaced apart from an outer surface of the pocket 238 by a third length L3. An outer surface of the pocket 234 is spaced apart from an outer surface of the pocket 236 by a fourth length L4. In an example, each of the first length L1, the second length L2, the third length L3, and the fourth length L4 are the same, or about the same. In alternate examples, one or more of the first length L1, the second length L2, the third length L3, and the fourth length L4 vary from one another. In an example, the first length L1, the second length L2, the third length L3, and/or the fourth length are about 9 mm. Alternatively, the first length L1, the second length L2, the third length L3, and/or the fourth length L4 are about 12 mm.

Figure 3C:
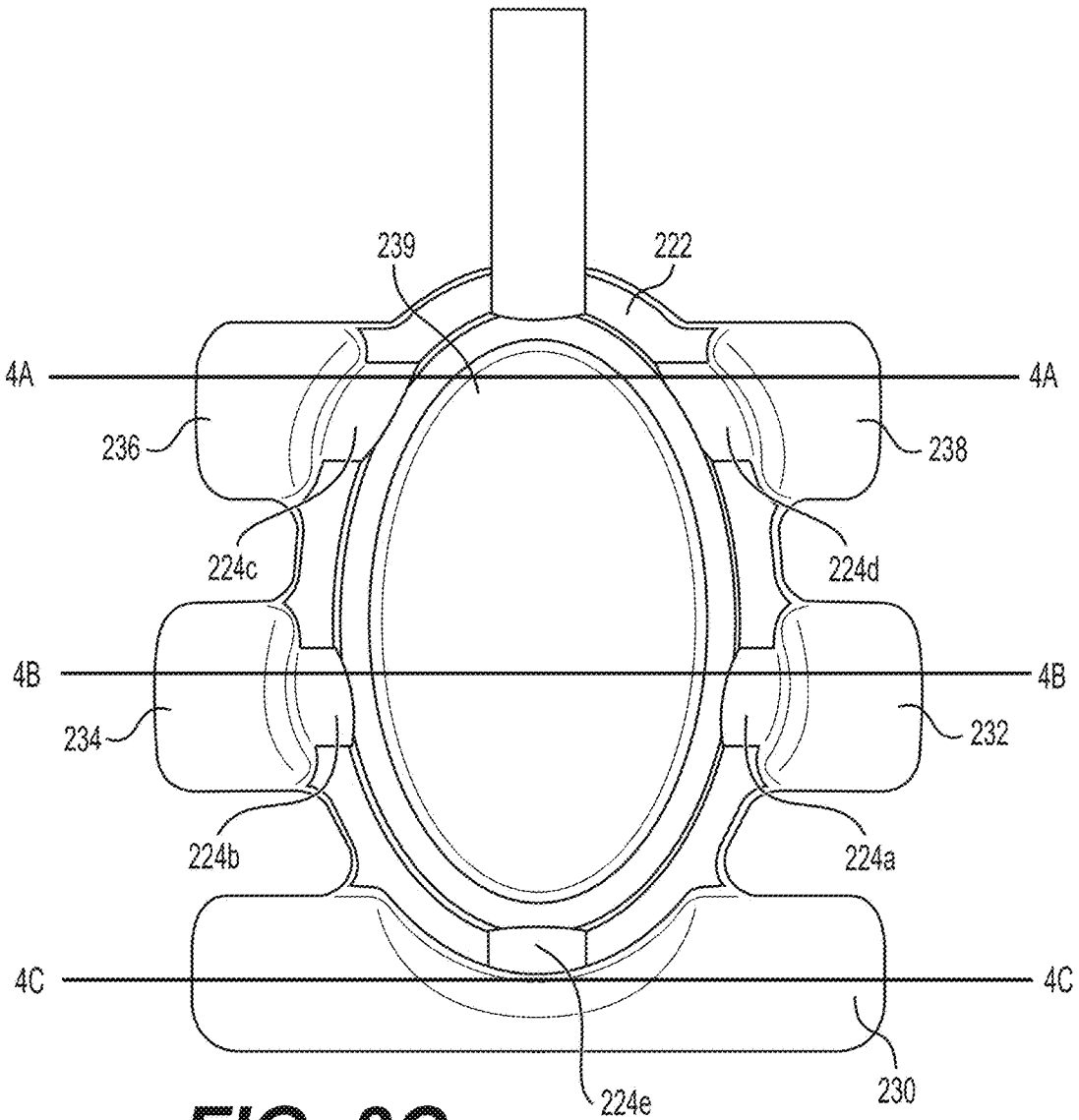
FIG. 3C is a bottom view of the cushioning element of FIG. 3A.

Referring to FIG. 3C, channels 224*a*, 224*b*, 224*c*, 224*d*, and 224*e* extend between each of pockets 230, 232, 234, 236, and 238 and central pod 239, respectively, corresponding to a width (e.g., in a medial-lateral direction) of the channels 224*a*, 224*b*, 224*c*, 224*d*, and 224*e*. The width of channels 224*a*, 224*b*, 224*c*, 224*d*, and 224*e* is about the width of the web area 222 between each of pockets 230, 232, 234, 236, and 238 and central pod 239, respectively. Channels 224*a*, 224*b*, 224*c*, 224*d*, and 224*e* are not in fluid communication with central pod 239, nor pockets 230, 232, 234, 236, and 238. In alternative examples, channels 224*a*, 224*b*, 224*c*, 224*d*, and 224*e* may be in fluid communication with central pod 239, and pockets 230, 232, 234, 236, and 238. The channels 224*a*, 224*b*, 224*c*, 224*d*, and/or 224*e* are disposed adjacent to the outsole layer 110 such that the channels 224*a*, 224*b*, 224*c*, 224*d*, and/or 224*e* are disposed on the bottom, ground-facing, surface of the cushioning element 104. In alternative embodiments, any one or more of the channels could be disposed on the top, upper-facing, surface of the cushioning element 104 or disposed within the cushioning element 104.

Figure 3D:
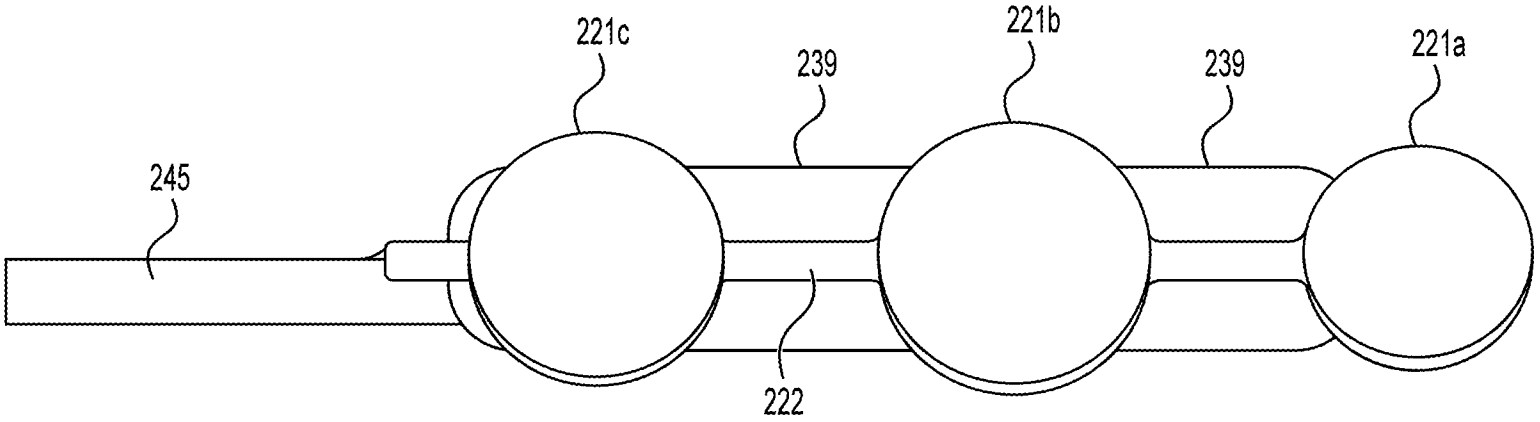
FIG. 3D is a side view of the cushioning element of FIG. 3A.

FIG. 3D shows a side view of the cushioning element 104. A height of the central pod 239 may be less than a height of the pockets 230, 232, 234, 236, 238. In alternative embodiments, a height of the central pod 239 may be greater than a height of the pockets 230, 232, 234, 236, 238. In some other alternative embodiments, a height of the central pod 239 may be the same as a height of the pockets 230, 232, 234, 236, 238. In some other alternative embodiments, a height of the central pod 239 may be the same as a height of some of the pockets 230, 232, 234, 236, 238. In some other alternative embodiments, a height of the central pod 239 may be less than a height of some of the pockets 230, 232, 234, 236, 238. In some other alternative embodiments, a height of the central pod 239 may be greater than a height of some of the pockets 230, 232, 234, 236, 238.

Figure 4A:
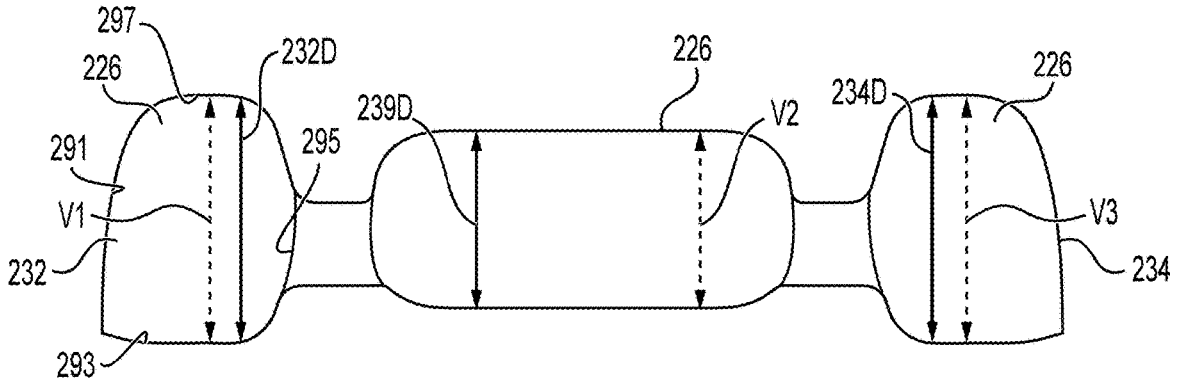
FIG. 4A is a cross-sectional view of the cushioning element of FIG. 3A, taken along line 4A-4A.
Figure 4B:
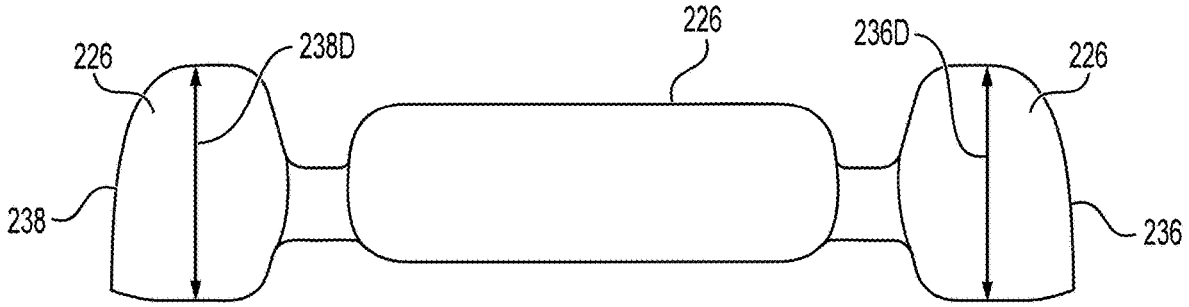
FIG. 4B is another cross-sectional view of the cushioning element of FIG. 3A, taken along line 4B-4B.
Figure 4C:
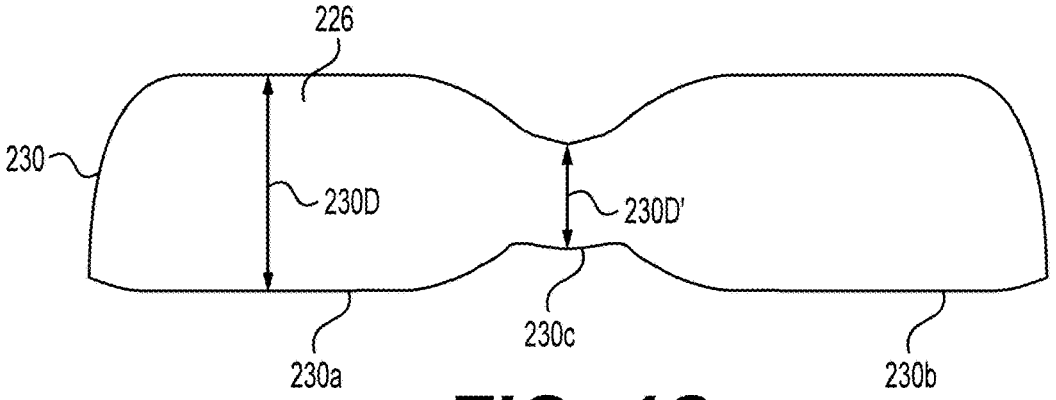
FIG. 4C is another cross-sectional view of the cushioning element of FIG. 3A, taken along line 4C-4C.

With reference to FIGS. 4A, 4B, and 4C, a cross-section taken along lines 4A-4A, 4B-4B, and 4C-4C, respectively, shows a space may be formed between opposing interior surfaces of each of the pockets 230, 232, 234, 236, 238, and central pod 239 to define each respective interior void 226. As shown in reference to pocket 232 in FIG. 4A, the interior surfaces of each of the pockets 230, 232, 234, 236, 238, and central pod 239 include medial (first) interior surface 291, interior (fourth) surface 293, lateral (second) interior surface 295, and upper (third) interior surface 297. Similarly, exterior surfaces of each of the pockets 230, 232, 234, 236, 238, and central pod 239 define an exterior profile of the cushioning element 104.

Pockets 230, 232, 234, 236, 238, and central pod 239 of the cushioning element 104 include an average cross-sectional dimension (e.g., an average height). The average height can be the average of all heights of a given longitudinal-vertical plane. The longitudinal-vertical plane is taken at a midpoint of the respective pockets 230, 232, 234, 236, 238, and central pod 239 along and perpendicular to the medial-lateral axis AML. The pockets 230, 232, 234, 236, 238, and central pod 239 can be sliced and viewed along a line extending parallel to the vertical plane 8-8, the line representing a height. As an example, a vertical line V1 extends between upper interior surface 297 and interior surface 293 of the pocket 232. A vertical line V2 extends between upper interior surface 297 and interior surface 293 of the central pod 239. A vertical line V3 extends between upper interior surface 297 and interior surface 293 of the pocket 234. Any given vertical line (e.g., vertical lines V1, V2, and V3) that extends from upper interior surface 297 to interior surface 293, is considered a height of the respective pockets 230, 232, 234, 236, 238, and central pod 239. The collection of the vertical lines within a respective pocket are averaged to give the average height (230D, 232D, 234D, 236D, 238D, and 239D).

Therefore, the term "average height" as used throughout this detailed description and in the claims should be understood to mean an average of the height of the respective pockets 230, 232, 234, 236, 238, and central pod 239 over different portions and does not necessarily refer to the height of the respective pockets 230, 232, 234, 236, 238, and central pod 239 at a particular portion.

The average heights of each of the respective pockets 230, 232, 234, 236, 238, and central pod 239 extend parallel to a plane containing the vertical axis 8-8. The average height is the average of the values attained via a plurality of lines taken between the inner surfaces of each of the respective pockets 230, 232, 234, 236, 238, and central pod 239 and parallel to the vertical axis 8-8. Pocket 230 has a first average height 230D and a second average height 230D'. The first average height 230D is different from the second average height 230D'. The first average height 230D is disposed within either of a medial portion 230*a* or a lateral portion 230*b* of pocket 230, and the second average height 230D' is disposed within a central portion 230*c* of pocket 230. Pocket 232 has an average height 232D. Pocket 234 has an average height 234D. Pocket 236 has an average height 236D. Pocket 238 has an average height 238D. Central pod 239 has an average height 239D. The average heights 230D, 230D', 232D, 234D, 236D, 238D, and 239D are between about 0.5-about 10 cm. In an example, average height 230D is about 5 cm. In an example, average height 230D' is about 2 cm. In an example, average height 232D is about 7 cm. In an example, average height 234D is about 7 cm. In an example, average height 236D is about 5 cm. In an example, average height 238D is about 5 cm. In an example, average height 239D is about 3 cm.

In one example, the average height of each of the respective pockets 230, 232, 234, 236, 238, and central pod 239 is the same when viewed in the plane extending parallel to vertical axis 8-8. The average height is 5 cm in this embodiment. In one example, the average height varies when viewed in the plane extending parallel to the vertical axis 8-8. For example, when moving from the medial side 22 to the lateral side 24, the average height may decrease. As another example, when moving from the medial side 22 to the lateral side 24, the average height may increase. As another example when moving from the medial side 22 to the lateral side 24, the average height is taller at outer areas of the respective pockets 230, 232, 234, 236, 238 and shorter at inner areas of the respective pockets 230, 232, 234, 236, 238. The outer areas being located at the respective ends of each of pockets 230, 232, 234, 236, and 238. The respective ends including the medial faces 221*a*, 221*b*, and 221*c* and the lateral faces 223*a*, 223*b*, and 223*c*, and an area disposed directly adjacent the web area 222. The inner area disposed between the respective outer areas.

In one example, the heights 232D, 234D, 236D, and 238D of each of the pockets 232, 234, 236, and 238 are substantially similar or the same. In one example, the heights 232D, 234D, 236D, and 238D of each of the pockets 232, 234, 236, and 238 vary from one another.

Figure 5:
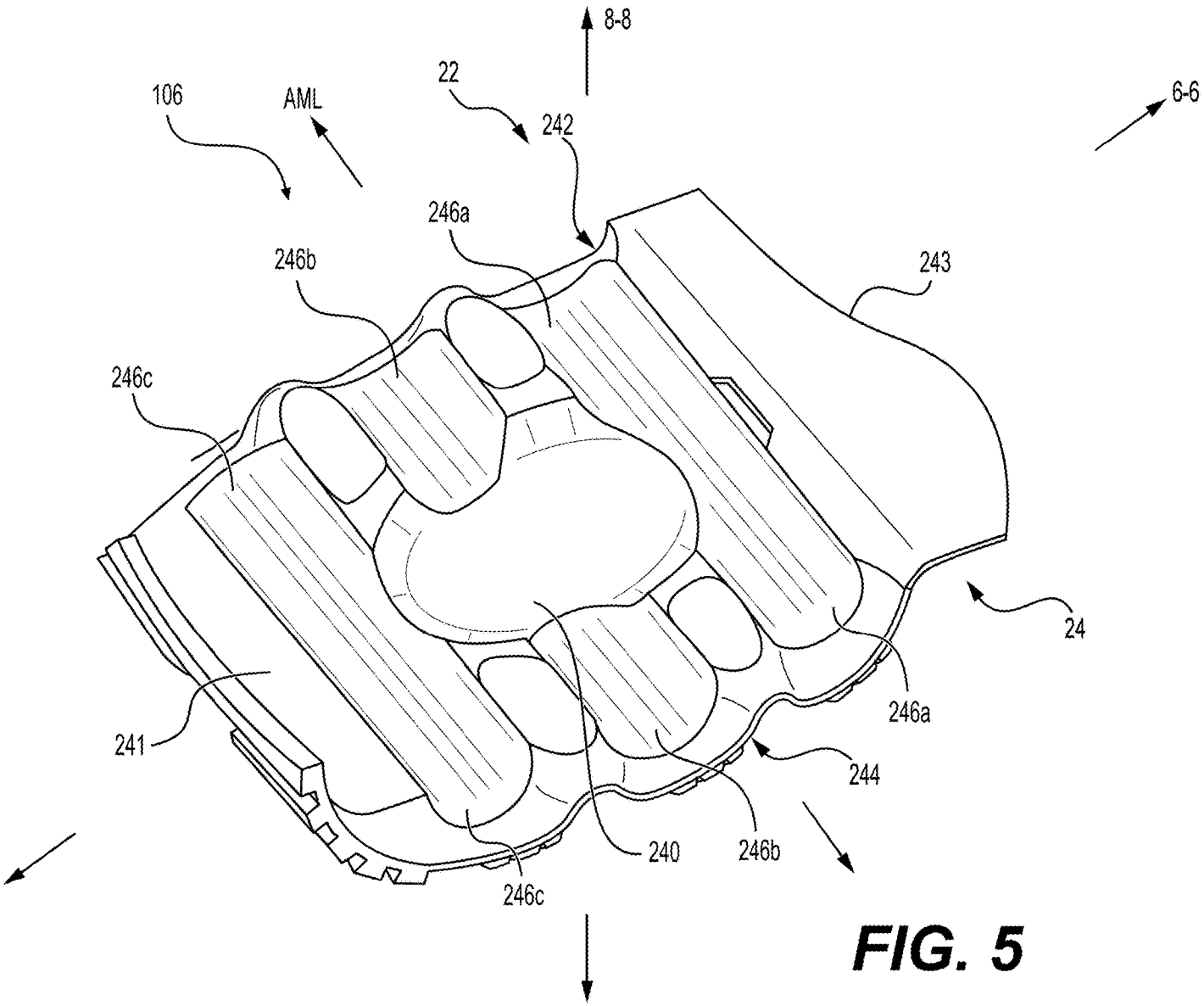
FIG. 5 is a top perspective view of a portion of an outsole of the sole structure of FIG. 2.

Referring to FIG. 5, second support element 106 includes a medial segment 242 and a lateral segment 244. Segment 242 is disposed on the medial side 22 and segment 244 is disposed on the lateral side 24. Second support element 106 includes a heel portion 241 and a mid-foot portion 243. Second support element 106 extends from the heel region 16 to the mid-foot region 14. In other examples, the second support element 106 may extend from the heel region 16 to the forefoot region 12. In other examples, the second support element 106 may extend only in the heel region 16.

The second support element 106 further includes a receptacle 240 bounded by segment 242, segment 244, heel portion 241, and mid-foot portion 243. Receptacle 240 may have an ovular shape. It is contemplated that receptacle 240 can be shaped as a diamond, square, circle, or the like suitable for receiving the central pod 239.

The medial segment 242 and the lateral segment 244 of second support element 106 includes one or more recesses. The one or more recesses are formed on a top surface of medial segment 242 and lateral segment 244. The one or more recesses may include one, two, three, four, five or more recesses. In an example, recesses include two pairs of recesses 246*a* and 246*b* and a recess 246*c*. The recesses have a substantially curved shape. Each individual recess 246*a*, 246*b*, and 246*c* is configured to receive respective pockets 230, 232, 234, 236, and 238. It is contemplated that the recesses include any shape suitable for receiving the pockets 230, 232, 234, 236, and 238 of the cushioning element 104. When viewing the second support element 106 from the exterior, the second support element 106 undulates between peaks and valleys or has an otherwise serpentine curve. The valleys corresponding with the recesses. The peaks corresponding with the portions of the respective medial segment 242 and lateral segment 244 separating adjacent recesses.

Figure 6A:
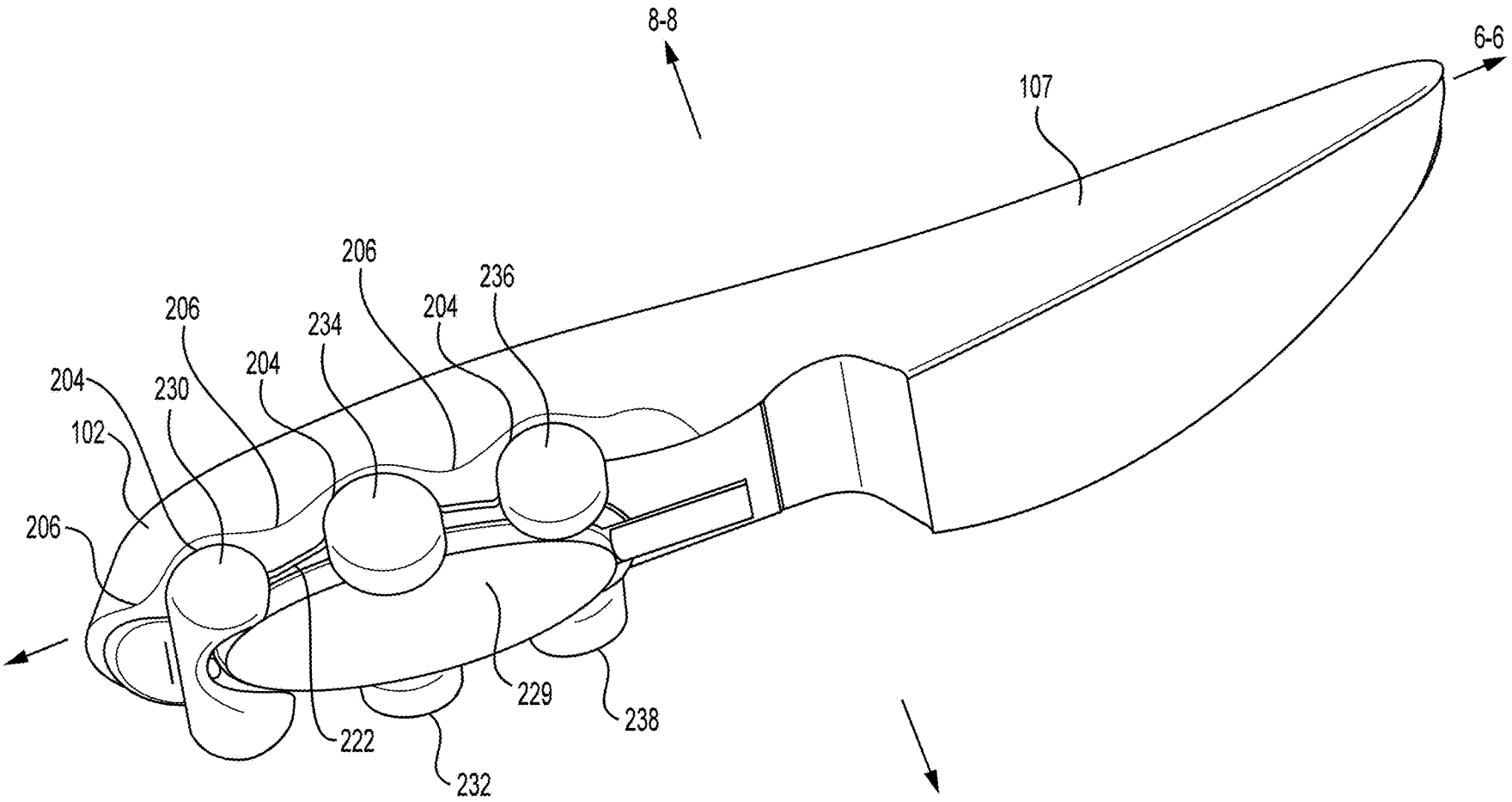
FIG. 6A is a bottom perspective view of a midsole and a cushioning element of the sole structure of FIG. 2.
Figure 6B:
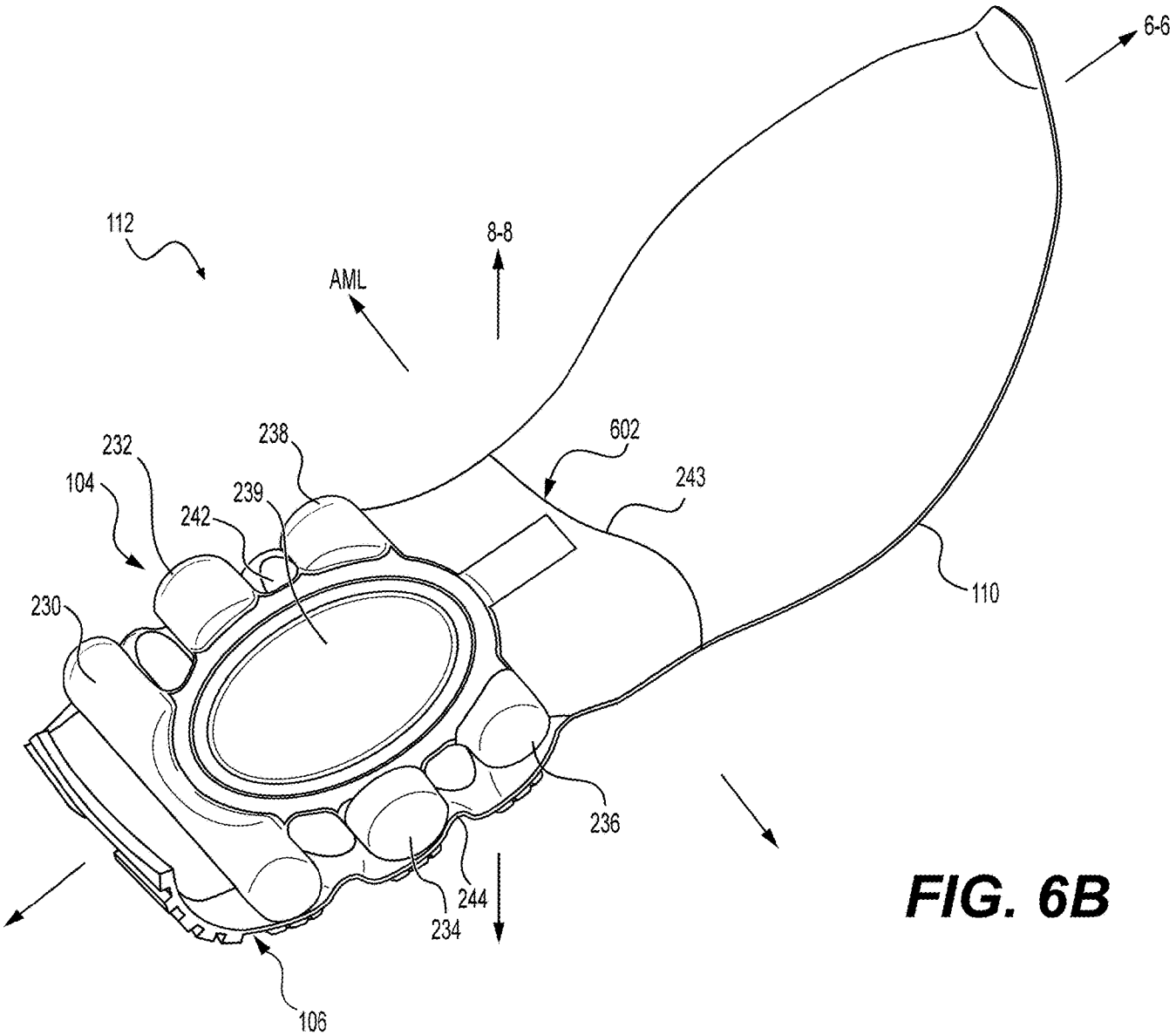
FIG. 6B is a top perspective view of an outsole and a cushioning element of the sole structure of FIG. 2.

Referring to FIG. 6A, the cushioning element 104 is coupled to the first support element 107. Referring to FIG. 6B, the cushioning element 104 is coupled to the second support element 106. The second support element 106 is coupled with the outsole layer 110 at a connecting region 602. The connecting region 602 is disposed in the mid-foot region 14. When assembled, the one or more pockets 230, 232, 234, 236, 238 of the cushioning element 104 fit within the confines of recesses 204 of first support element 107 (shown in FIG. 2) and recesses 246*a*, 246*b*, 246*c* of second support element 106 (shown in FIG. 5). When assembled, the recesses 246*a*, 246*b*, 246*c* form a continuous receiving area for the one or more pockets 230, 232, 234, 236, 238, and central pod 239. In an example, the recesses 204 of the first support element 107 rest on a top surface of the pockets 230, 232, 234, 236, 238, and central pod 239 and the mounds 206 extend down toward the web area 222, but does not contact any of the web area 222 while the shoe is at rest without a foot of a user inserted therein. It is contemplated that in alternative examples, the recesses 204 of first support element 107 do not contact the top surface of the pockets 230, 232, 234, 236, 238, and central pod 239. In further alternative examples, the recesses 204 contact outer peripheries of the pockets 230, 232, 234, 236, and 238, but do not contact the central pod 239.

The second support element 106 receives a bottom surface of the pockets 230, 232, 234, 236, 238, central pod 239, and the web area 222, as shown in FIG. 6B. In alternative examples, the second support element 106 may not be in contact with the web area 222 such that a gap remains between the web area 222 and the second support element 106.

Figure 7:
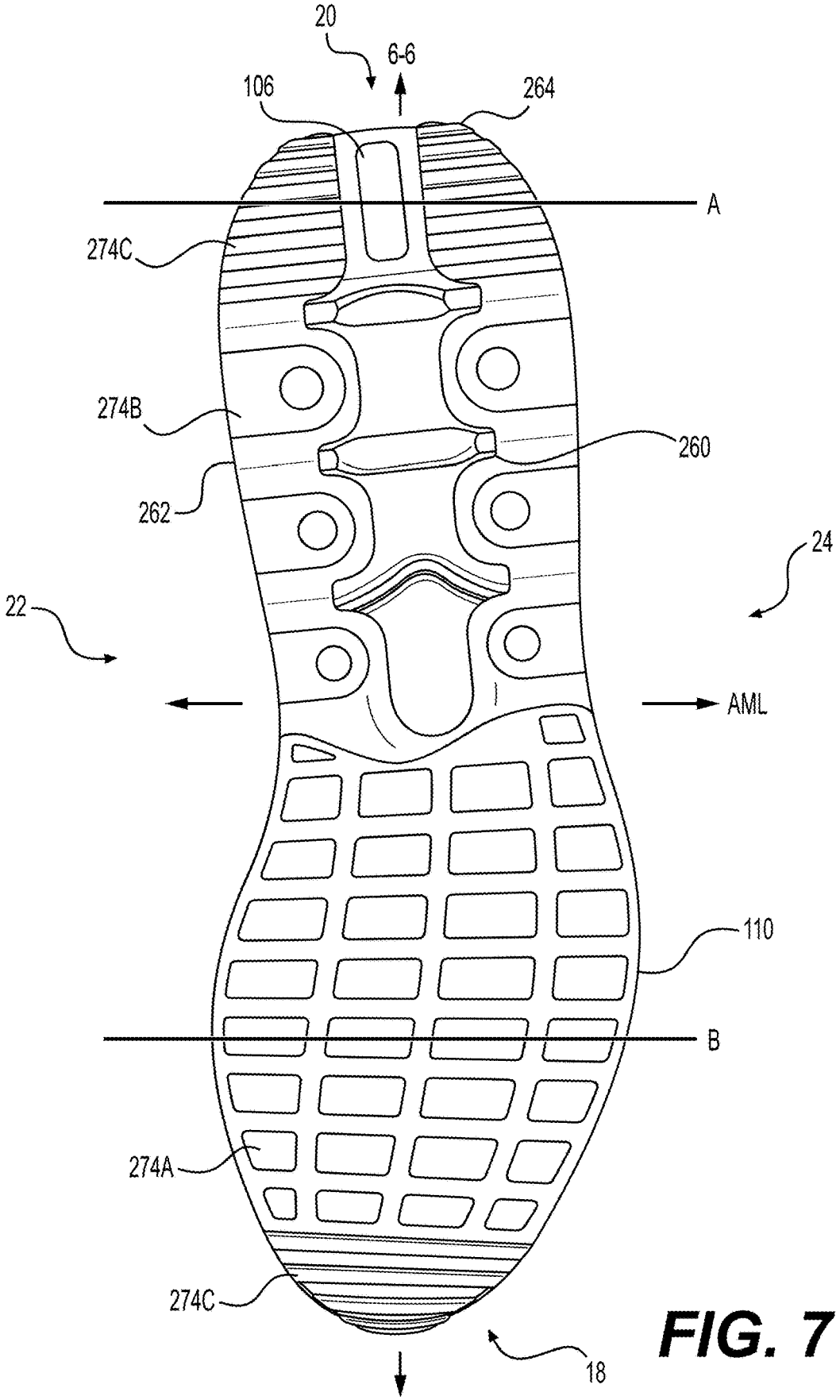
FIG. 7 is a bottom view of the article of footwear of FIG. 1.

Referring to FIG. 7, second support element 106 and outsole layer 110 include a plurality of traction elements disposed on a bottom surface thereof. In an example, the plurality of traction elements include one of traction element shapes 274A, 274B, and 274C. The plurality of traction elements 274A, 274B, and 274C having traction element shape 274A extend from a mid-foot region 14 to the forefoot region 12. Traction elements 274A do not extend all the way through forefoot region 12 to the anterior end 18. The plurality of traction elements 274A, 274B, and 274C having traction element shape 274B extends between a portion of the heel region 16 through the mid-foot region 14. Traction elements 274B are adjacent to the traction elements 274A and the traction elements 274C. The plurality of traction elements 274A, 274B, and 274C having traction element shape 274C are present in the heel region 16 and the forefoot region 12. Traction elements 274C are adjacent to the traction elements 274A and 274B. Traction elements 274A and 274A are disposed between the traction elements 274C, thereby dividing the traction elements 274C into separate groupings of traction elements 274C. The plurality of traction elements 274A-274C have a substantially square shape. It is contemplated that the plurality of traction elements 274A, 274B, and 274C may be rectangular, ovular, triangular, irregular, linear, or any shape that provides a desired form of grip to the article of footwear 10. Traction elements may be arranged in any configuration suitable for providing a desired form of grip or traction to the article of footwear 10.

When viewing the bottom of the sole structure 101 along the exterior path of line A, the bottom of the sole structure 101 may include the medial segment 242 and the lateral segment 244, second support element 106, and central portion 260 of the outsole layer 110. When viewing the bottom of the sole structure 101 along the exterior path of line B, the sole structure 101 may include solely the outsole layer 110.

Figure 9:
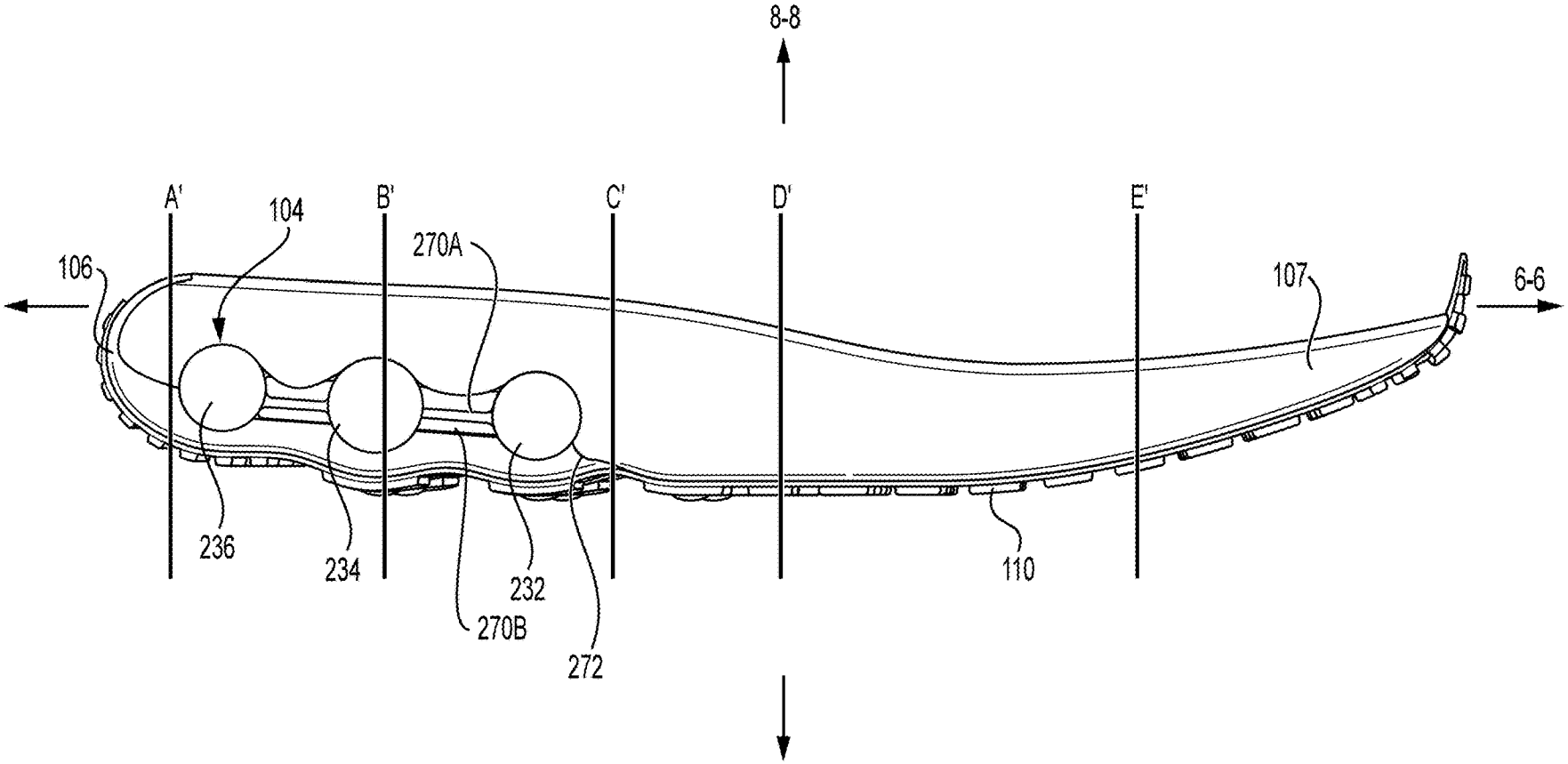
FIG. 9 is a side view of the sole structure of the article of footwear of FIG. 1.

Referring to FIG. 9, the first support element 107 and the outsole layer 110 directly contact one another at contact area 272 that may extend along the mid-foot region 14 to the forefoot region 12. As shown in the cross-section, each of the first support element 107, second support element 106, and cushioning element 104 are sized and shaped to fit together. The second support element 106 extends around rear portions of the first support element 107.

Referring to FIG. 9, the space between the web area 222 and either the mounds 206 or the respective medial segment 242 and lateral segment 244, separating adjacent recesses 246, form one or more exposed gaps 270, including a first gap 270A and a second gap 270B (shown in FIG. 1). In other words, the first support element 107 covers a top surface of the pockets 230, 232, 234, 236, 238, and central pod 239 such that the one or more exposed gaps 270A and 270B remain between the mounds 206 and the web area 222. Gaps 270A and 270B extend from the medial side 22 to the lateral side 24 corresponding to a width of the article of footwear. Gap 270A extends from the first support element 107 to web area 222. Gap 270B extends from the second support element 106 to web area 222. The gaps 270A and 270B are a respective distance between the web area 222, first support element 107, and second support element 106. The width of the gaps 270A and 270B extends parallel to the medial-lateral axis AML. The height of the gaps 270A and 270B extends parallel to the vertical axis 8-8.

The gaps 270A and 270B leave exposed the web areas 222 of the cushioning element 104. In other words, the assembled sole structure 101 forms gaps 270A and 270B in the heel region 16 and the mid-foot region 14 between the first support element 107 and the second support element 106 such that a viewer would see the central pod 239. In other words, when viewed from a vantage point that is exterior to the sole structure 101, the web areas 222 are open to the environment.

In one example, the gaps 270A on the medial side 22 are larger than the gaps 270A on the lateral side 24. In one example, the gaps 270B on the medial side 22 are larger than the gaps 270B on the lateral side 24.

In one example, the gaps 270A on the medial side 22 are smaller than the gaps 270A on the lateral side 24. In one example, the gaps 270B on the medial side 22 are smaller than the gaps 270B on the lateral side 24.

Figure 10:
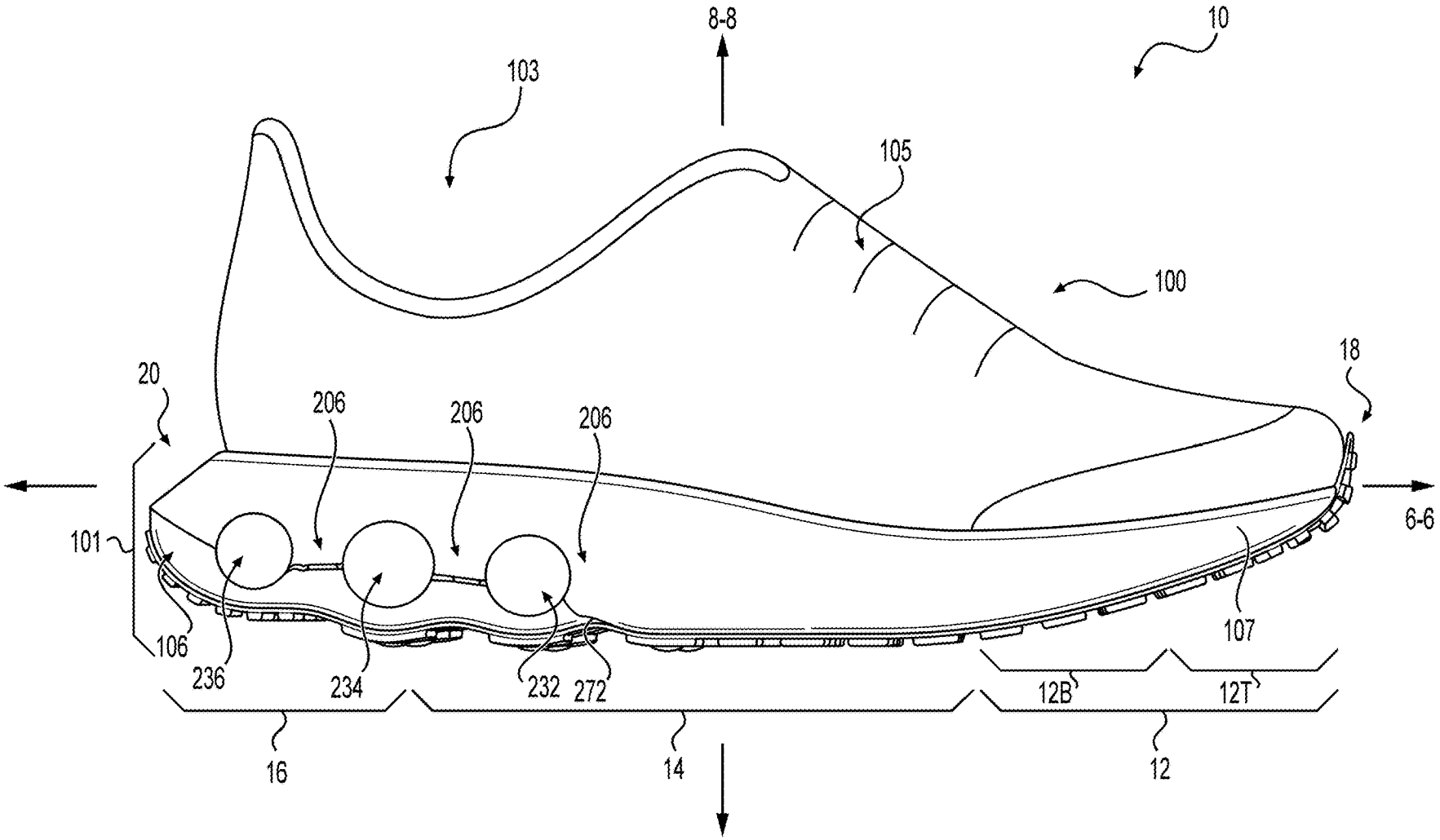
FIG. 10 is a side view of an alternative embodiment of an article of footwear.

With continued reference to the side view shown in FIG. 10, when the exterior of the footwear 10 is viewed from the ground up, the sole structure 101 includes the outsole layer 110, the second support element 106, the cushioning element 104, and the first support element 107.

When viewing the sole structure 101 from the ground up along the exterior path of line A', the sole structure may include the outsole layer 110, the second support element 106, and the first support element 107. When viewed along the exterior path of line B', the sole structure 101 may include the outsole layer 110, the second support element 106, one of pockets 230, 232, 234, 236, and/or 238 of the cushioning element 104, and the first support element 107. When viewed along the exterior path of line C', the sole structure 101 may include the outsole layer 110, the exposed gap 270B, the web area 222, the exposed gap 270A, and the first support element 107. When viewed along the exterior path of line D', the sole structure 101 may include the outsole layer 110, the second support element 106, and the first support element 107. When viewed along the exterior path of line E', the sole structure 101 may include the outsole layer 110 and the first support element 107.

The combination of the first support element 107, the second support element 106, and the cushioning element 104 disposed between the first support element 107 and the second support element 106 provides improved sensation and performance during use of the article of footwear 10. In an exemplary embodiment, when the cushioning element 104 is the fluid-filled bladder, the first support element 107 is an elastomeric material, and the second support element 106 is an elastomeric material, the sole structure 101 provides a uniquely durable and comfortable sensation to a user of the article of footwear 10. Additionally, when the article of footwear 10 is configured with the gaps 270, the cushioning element 104 is given room to move around within the article of footwear 10. In other words, the cushioning element 104 is allowed to flex, expand, contract, and/or slide within the article of footwear 10. In this example, the responsiveness of the cushioning element 104 is improved.

In alternative examples, the plurality of recesses 204 and the plurality of mounds 206 do not extend into the mid-foot region 14 and are disposed solely in the heel region 16. In other examples, the plurality of recesses 204 and the plurality of mounds 206 extend through the entirety of the mid-foot region 14. It is further contemplated that the plurality of recesses 204 and the plurality of mounds 206 extend through the entirety of the mid-foot region 14 and into a portion or an entirety of the forefoot region 12. It is further contemplated that the plurality of recesses 204 and the plurality of mounds 206 extend longitudinally across the entirety of the first support element 107 from the heel region 16 through the forefoot region 12.

In some examples, e.g. as shown in FIG. 10, there are no gaps between first support element 107 and cushioning element 104, and also no gaps between second support element 106 and cushioning element 104. For example, the recesses 204 of the first support element 107 rest on a top surface of the pockets 230, 232, 234, 236, and 238 and the mounds 206 extend down toward the web area 222. In this alternative example, the mounds 206 contact the top or bottom of the web area 222 while the shoe is at rest without a foot of a user inserted therein. In other words, there is no exposed gap between the mounds 206 and the web area 222. The mounds 206 rest flush with the web area 222. The first support element 107 covers an entirety of a top surface of the cushioning element 104. Additionally, a bottom surface of the cushioning element 104 is enclosed by the second support element 106 such that there is no gap between the cushioning element 104 and the second support element 106. In this alternative example, an entirety of the top surface and an entirety of the bottom surface of the cushioning element 104 are enclosed by the first support element 107 and the second support element 106 respectively. Rear portions of the first support element 107 and the second support element 106 may rest flush with one another at the posterior end 20 forming a flush interface.

Figure 11:
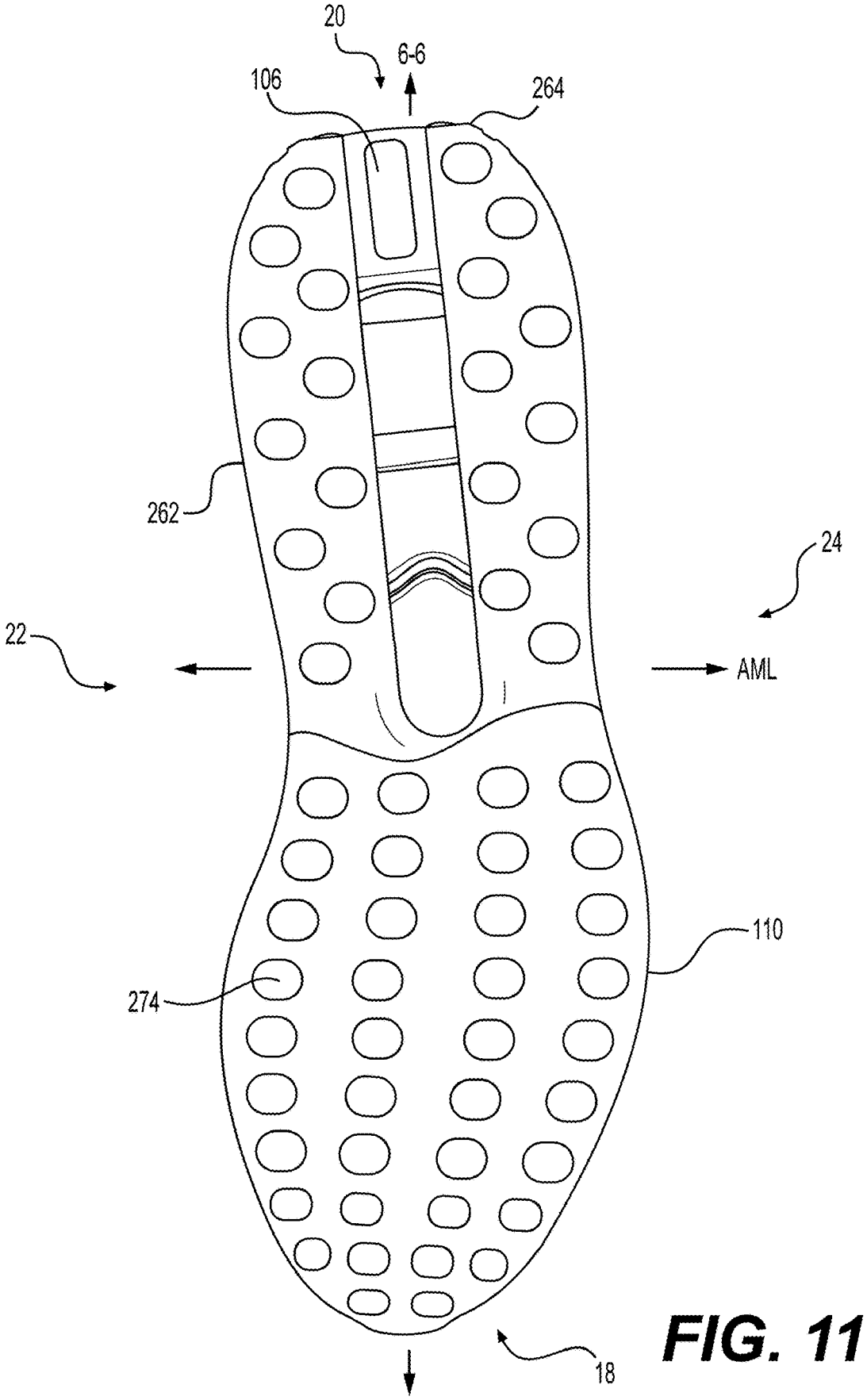
FIG. 11 a bottom view of an alternative embodiment of another article of footwear.
Figure 12:
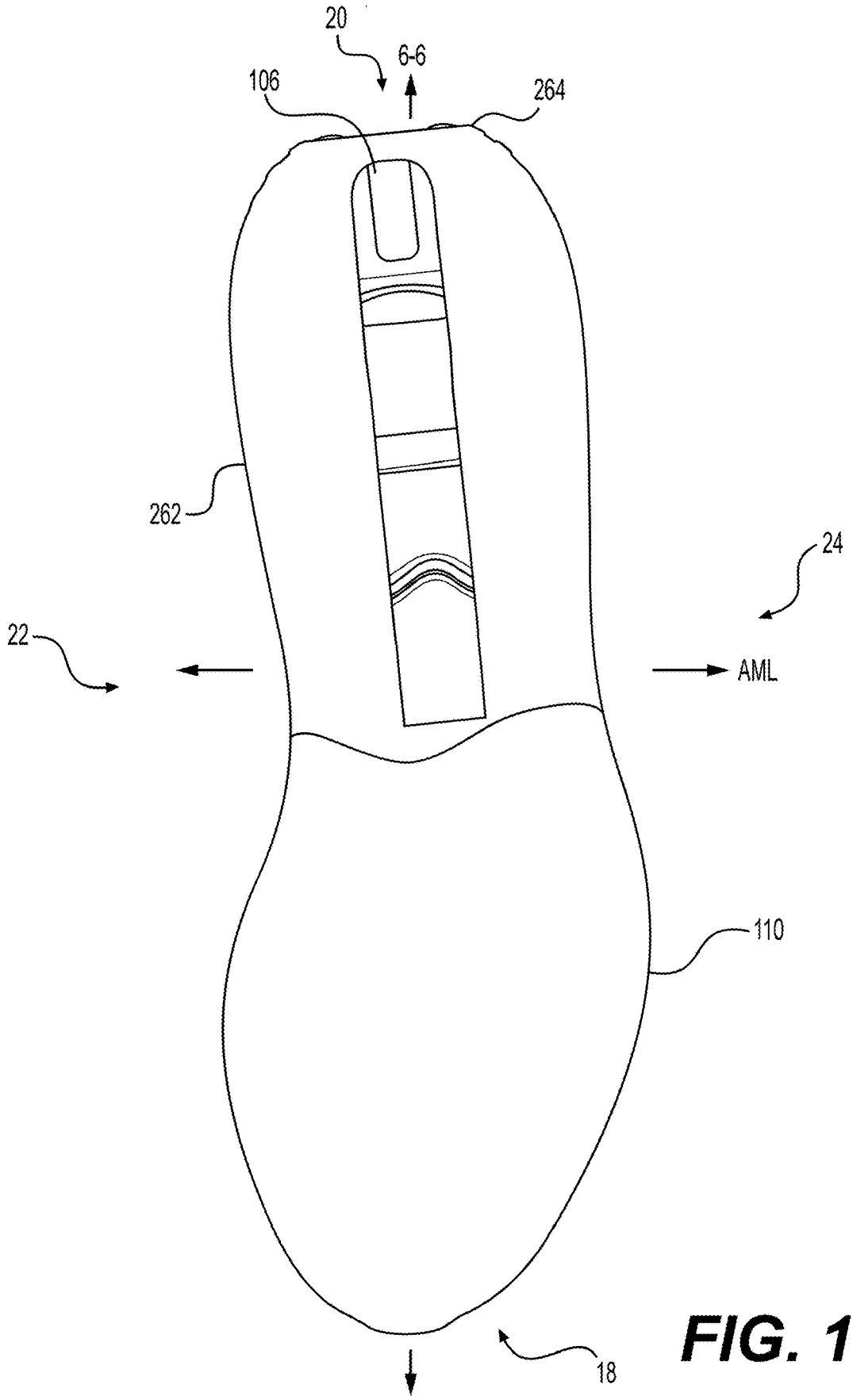
FIG. 12 is a bottom view of an alternative embodiment of another article of footwear.

In alternative examples, shown in FIG. 11, the plurality of traction elements 274 include only one shape. In the alternative embodiment shown in FIG. 12, outsole layer 110 is devoid of traction elements 274. In other words, in alternative embodiments, outsole layer 110 has a bottom surface that is smooth or relatively smooth.

Figure 13:
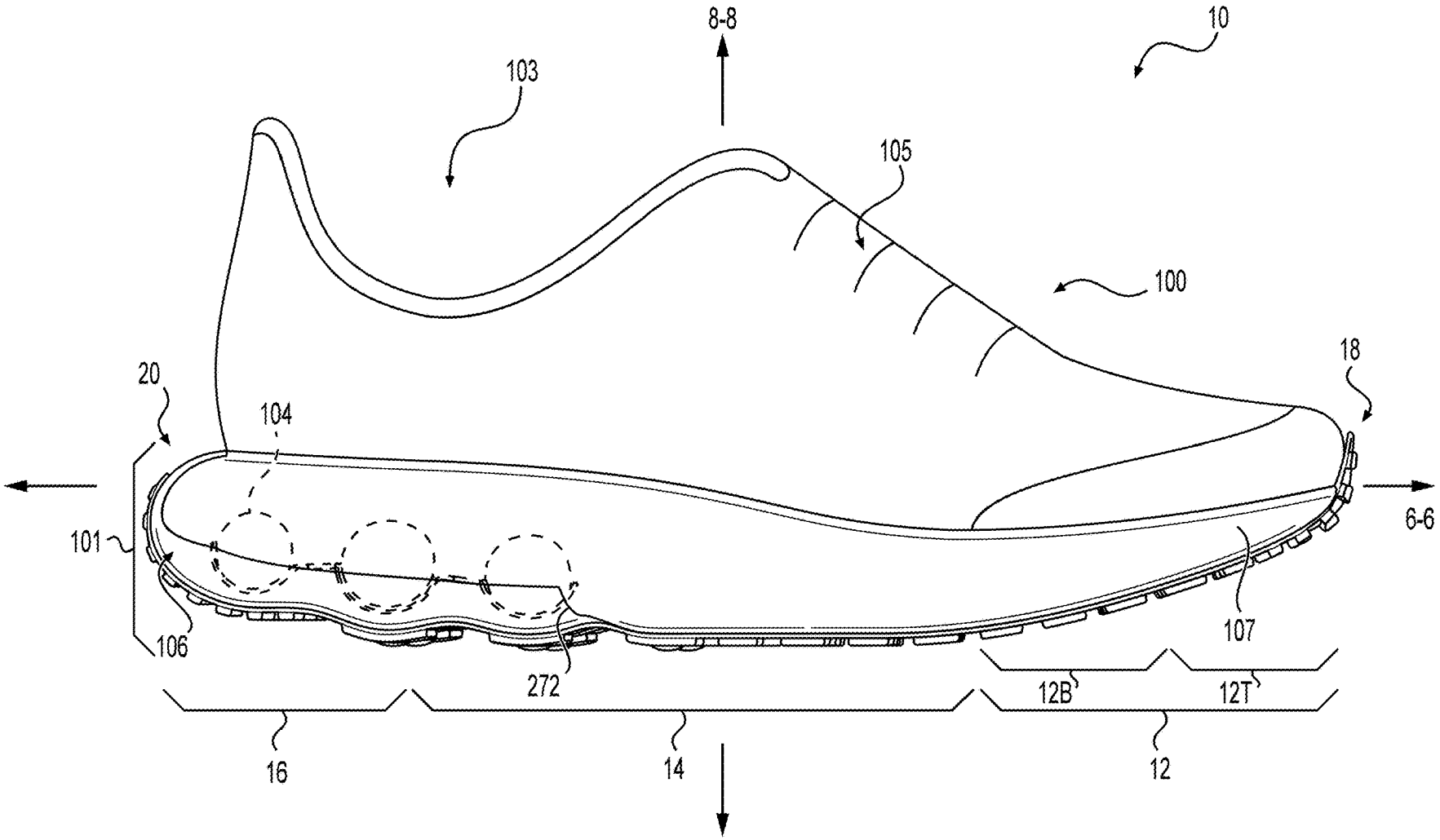
FIG. 13 is a side view of an alternative embodiment of another article of footwear.
Figure 14:
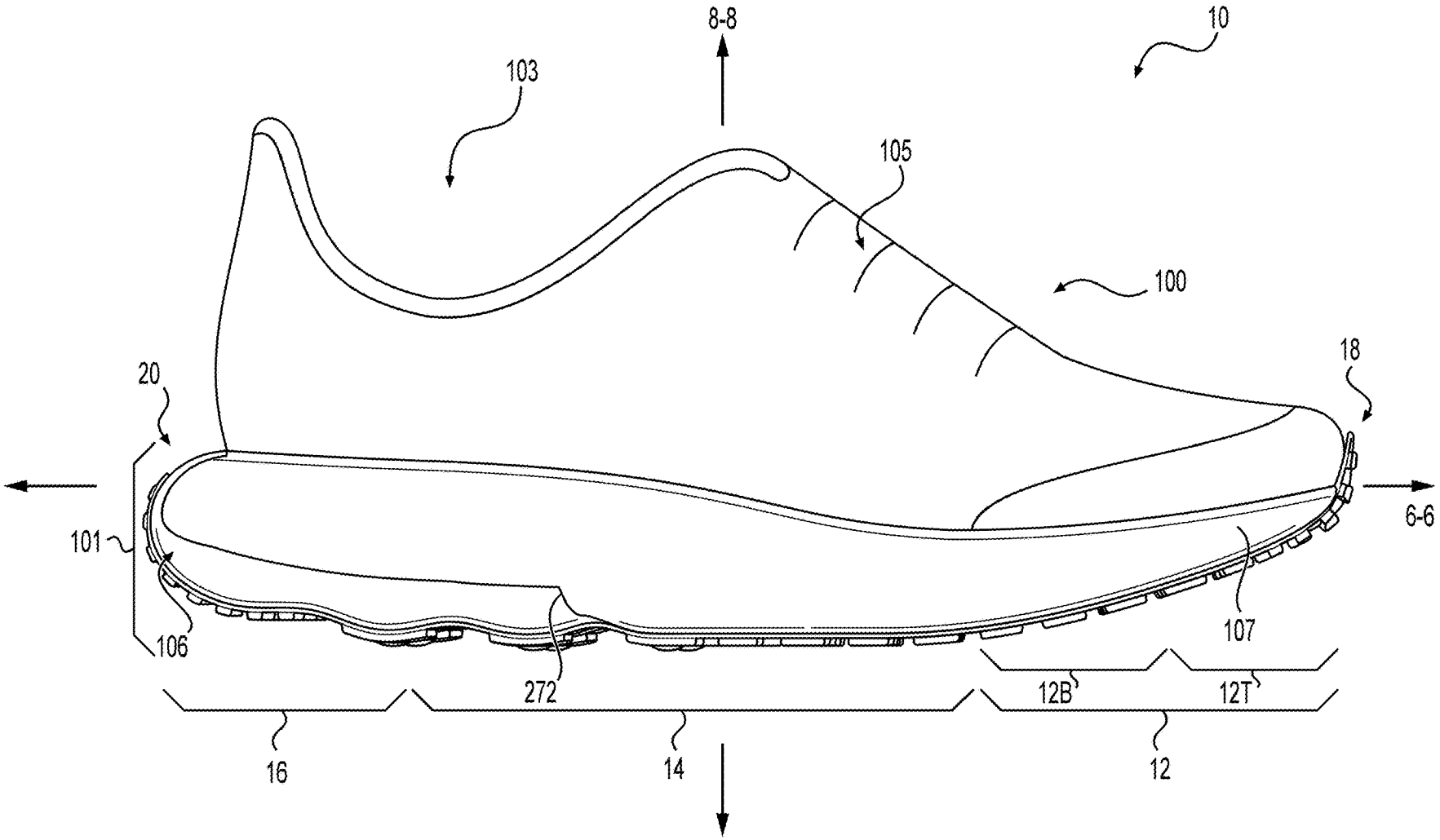
FIG. 14 is a side view of the alternative embodiment of another article of footwear of FIG. 13.

The article of footwear 10 includes alternatively shaped elements to provide varying underfoot sensation. FIGS. 13 and 14 show an example of an alternative sole structure where the cushioning element 104 is not visible from an exterior view of the article of footwear 10. The cushioning element 104 is housed entirely within the midsole 102 of the sole structure 101. It is contemplated that the cushioning element 104 may be only partially enclosed by the midsole 102.

It is contemplated that in other alternative examples, the cushioning element 104 may directly contact the outsole layer 110. In other words, the second support element 106 may be omitted in certain alternative examples. In other alternative examples, the cushioning element 104 may directly contact a ground surface. In other words, the outsole layer 110 may not extend to the heel region, and the second support element 106 may be omitted. In other alternative examples, the sole structure 101 may be of a unitary construction.

In some examples, a blow-molding process may be utilized to form portions or all of cushioning element 104. In general, a suitable blow-molding process involves positioning inserts within at least one of two mold portions and then positioning a parison between the mold portions. The parison is a generally hollow and tubular structure of molten polymer material. In forming the parison, the molten polymer material is extruded from a die. The wall thickness of the parison may be substantially constant, or may vary around the perimeter of the parison. Accordingly, a cross-sectional view of the parison may exhibit areas of differing wall thickness. Following placement of the parison between the mold portions, the mold portions close upon the parison and pressurized air within the parison induces the liquefied elastomeric material to contact the surfaces of the mold. In addition, closing of the mold portions and the introduction of pressurized air induces the liquefied elastomeric material to contact the surfaces of the inserts. Air may also be evacuated from the area between the parison and the mold to further facilitate molding and bonding.

In some examples, portions of the cushioning element 104 may be formed by respective mold portions during a thermoforming process. Each mold portion may define various surfaces for forming depressions and pinched surfaces corresponding to locations where the web area 222 is formed when upper and lower films are joined and bonded together. In some examples, adhesive bonding may join the upper film and the lower film to form the web area 222. In other examples, the upper film and the lower film may be joined to form the web area 222 by thermal bonding. In some examples, one or both of the films may be heated to a temperature that facilitates shaping and melding. In some examples, the films may be heated prior to being located between their respective molds. In other examples, the mold may be heated to raise the temperature of the films. In some implementations, a molding process used to form the pockets 230, 232, 234, 236, 238, and central pod 239 may incorporate vacuum ports within mold portions to remove air such that the upper and lower films are drawn into contact with respective mold portions. In other examples, fluids such as air may be injected into areas between the upper and lower films such that pressure increases cause the films to engage with surfaces of their respective mold portions. The fluid may be injected into pockets 230, 232, 234, 236, 238, and central pod 239 until a desired pressure is achieved. Once pockets 230, 232, 234, 236, 238, and central pod 239 achieve the desired pressure, pockets 230, 232, 234, 236, 238, and central pod 239 are fluidly sealed off from one another.

As used herein, the term "barrier film" "encompasses both monolayer and multilayer films. In some examples, one or both of barrier films are each produced (e.g., thermoformed or blow molded) from a monolayer film (a single layer). In other examples, one or both of barrier films are each produced (e.g., thermoformed or blow molded) from a multilayer film (multiple layers). The one or more pockets 230, 232, 234, 236, 238, and central pod 239 may be produced from barrier films using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an example, barrier films may be produced by co-extrusion followed by vacuum thermoforming to produce an inflatable tube of the one or more pockets 230, 232, 234, 236, 238, and central pod 239, which may optionally include one or more valves (e.g., one way valves) that allows the pockets 230, 232, 234, 236, 238, and central pod 239 to be filled with a fluid (e.g., gas) and formed as a fluid-filled barrier. Barrier films may each be produced from an elastomeric material that includes one or more thermoplastic polymers and/or one or more cross-linkable polymers. In an example, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular examples, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another example, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable. The cushioning elements described herein are resilient structures configured to retain a fluid, particularly a gas. Typically, the fluid needs to be retained over an intended lifetime of the cushioning element, including when the cushioning element is exposed to repeated cycles of applying and releasing force or pressure, as would be encountered when the cushioning element is used in an article of footwear. As many of the polymeric materials conventionally used to manufacture consumer goods are relatively impermeable to water and aqueous solutions but are permeable to small gas molecules such as air, oxygen ($O_2$) gas and nitrogen ($N_2$) gas and inert gasses, barrier materials, i.e., materials which have relatively low rates of fluid transmittance, and so provide relatively high levels of liquid and gas retention to the cushioning element, may be used alone or in combination with conventional polymeric materials. Thus, the cushioning elements described herein, including the various structures forming the cushioning elements, may comprise, consist essentially of, or consist of a barrier material.

Figure 8:
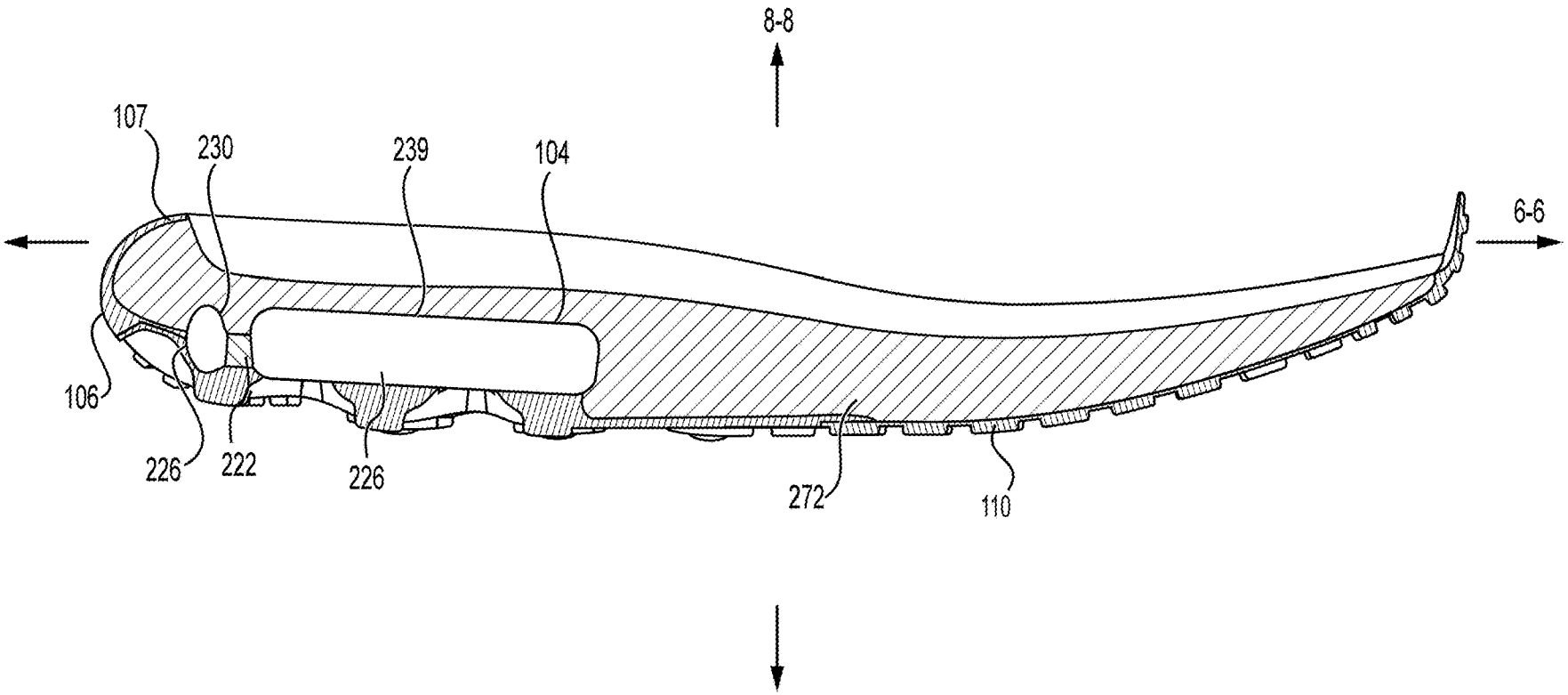
FIG. 8 is a cross-sectional view of the sole structure of article of footwear of FIG. 1.

The outsole layer 110, and traction elements 274A-274A (e.g., as shown in FIG. 8) of the outsole 112 may be formed of resilient materials configured to impart properties of abrasion resistance and traction to the sole structure 101. First support element 107 may be formed of a material having a higher hardness than that of second support element 106. For example, the first support element 107 may be formed of a foam material having a first hardness, while the second support element 106 may be formed of a foam material having a second hardness, less than the first hardness. The first support element may include a polymeric material such as a foamed polymeric material and/or an unfoamed (e.g., solid resin) polymeric material having a first hardness. The second support element 106 may include a polymeric material with a second hardness. It is contemplated that second support element 106 could include a second polymeric material having a third hardness or another suitable foam material capable of providing a desired cushioning characteristic. Alternatively, second support element 106 may include a solid polymeric material that may have a durometer that is different than the selected foam material.

The following clauses provide an exemplary configuration for an article of footwear and sole structure described above.

Clause 1. A sole structure having a lateral side and a medial side opposite the lateral side, the sole structure comprising: an outsole layer; a first support element including first recesses; a second support element coupled to the outsole layer and including second recesses; and a cushioning element disposed between the first support element and the second support element, the cushioning element including a plurality of pockets and a central pod, wherein a first subset of the plurality of pockets are disposed on the lateral side, a second subset of the plurality of pockets are disposed on the medial side, and a rear pocket of the plurality of pockets extends from the lateral side and the medial side, each of the first subset, the second subset, and the rear pocket being separated from the central pod by a web area, wherein the plurality of pockets are at least partially enclosed by the first recesses and the second recesses.

Clause 2. The sole structure of clause 1, wherein the cushioning element is a fluid-filled bladder.

Clause 3. The sole structure of clause 1, wherein a fluid of an interior of the cushioning element is at ambient pressure.

Clause 4. The sole structure of clause 1, wherein each of the plurality of pockets are fluidly separated from another of the plurality of pockets.

Clause 5. The sole structure of clause 1, wherein the central pod is fluidly separated from each of the plurality of pockets.

Clause 6. The sole structure of clause 1, wherein the first subset includes a front lateral pocket and a central lateral pocket.

Clause 7. The sole structure of clause 6, wherein the second subset includes a front medial pocket and a central medial pocket.

Clause 8. The sole structure of clause 7, wherein the rear pocket is disposed at a posterior most portion of the cushioning element.

Clause 9. The sole structure of clause 8, wherein the central lateral pocket is disposed between the rear pocket and the front lateral pocket.

Clause 10. The sole structure of clause 9, wherein the central medial pocket is disposed between the rear pocket and the front medial pocket.

Clause 11. The sole structure of clause 10, wherein the central pod is disposed between the rear pocket, the central medial pocket, the central lateral pocket, the front medial pocket, and the front lateral pocket.

Clause 12. The sole structure of clause 8, wherein the central medial pocket includes a dimension that is larger than the front medial pocket.

Clause 13. The sole structure of clause 8, wherein the central lateral pocket includes a dimension that is larger than the front lateral pocket.

Clause 14. The sole structure of clause 1, wherein the cushioning element includes a top surface and a bottom surface opposite the top surface, the bottom surface including a plurality of channels.

Clause 15. The sole structure of clause 14, wherein the first support element is coupled to the top surface of the cushioning element and the second support element is coupled to the bottom surface of the cushioning element.

Clause 16. The sole structure of clause 1, wherein the second support element coupled to the outsole forms at least a part of a ground-engaging surface of the sole structure.

Clause 17. The sole structure of clause 1, wherein a top surface of the outsole layer is in direct contact with a bottom surface of the first support element at an anterior position of the sole structure.

Clause 18. An article of footwear comprising: the sole structure of clause 1; and an upper coupled to the sole structure.

Clause 19. A cushioning element for an article of footwear, the cushioning element comprising: a plurality of pockets, the plurality of pockets including lateral pockets, medial pockets, and a rear pocket; a central pod, the central pod disposed between the lateral pockets, the medial pockets, and the rear pocket; a web area extending between the central pod and the plurality of pockets; and a plurality of channels extending between the central pod and each of the plurality of pockets.

Clause 20. The cushioning element of clause 19, wherein the lateral pockets include a front most lateral pocket and a central most lateral pocket, each of the front most lateral pocket and the central most lateral pocket disposed on a lateral side of the cushioning element.

Clause 21. The cushioning element of clause 20, wherein the medial pockets include a front most medial pocket and a central most medial pocket, each of the front most medial pocket and the central most medial pocket disposed on a medial side of the cushioning element.

Clause 22. The cushioning element of clause 21, wherein the rear pocket extends from the lateral side to the medial side.

Clause 23. The cushioning element of clause 22, wherein the rear pocket is spaced apart from the central pod by a first distance.

Clause 24. The cushioning element of clause 23, wherein the central most medial pocket is spaced apart from the central pod by a first distance.

Clause 25. The cushioning element of clause 24, wherein the central most lateral pocket is spaced apart from the central pod by a second distance.

Clause 26. The cushioning element of clause 25, wherein the front most medial pocket is spaced apart from the central pod by a third distance.

Clause 27. The cushioning element of clause 26, wherein the front most lateral pocket is spaced apart from the central pod by a fourth distance.

Clause 28. The cushioning element of clause 21, wherein the rear pocket is spaced apart from the central most medial pocket by a first length.

Clause 29. The cushioning element of clause 20, wherein the rear pocket is spaced apart from the central most lateral pocket by a second length.

Clause 30. The cushioning element of clause 21, wherein the central most medial pocket is spaced apart from the front most medial pocket by a third length.

Clause 31. The cushioning element of clause 20, wherein the central most lateral pocket is spaced apart from the front most lateral pocket by a fourth length.

Clause 32. The cushioning element of clause 19, wherein each of the plurality of pockets are fluidly isolated from one another, and wherein the central pod is fluidly isolated from each of the plurality of pockets.

Clause 33. An article of footwear incorporating the sole structure of clause 19.

Clause 34. A cushioning element having a lateral side and a medial side opposite the lateral side, the cushioning element comprising: a plurality of pockets, the plurality of pockets including lateral pockets, medial pockets, and a rear pocket, wherein the rear pocket extends from the lateral side to the medial side; a central pod, the central pod disposed between the lateral pockets, the medial pockets, and the rear pocket, wherein a fluid within the central pod is at ambient pressure; and a web area extending between the central pod and the plurality of pockets.

Clause 35. The cushioning element according to clause 34, wherein the rear pocket includes a depression disposed immediately adjacent to the web area.

Clause 36. The cushioning element according to clause 34, wherein a first pocket of the plurality of pockets includes a medial face and a lateral face, a second pocket includes a medial face, a third pocket includes a lateral face, a fourth pocket includes a medial face, and a fifth pocket includes a lateral face.

Clause 37. The cushioning element of clause 36, wherein each medial face and each lateral face includes a center point, and wherein the first pocket includes a width measured between the center point of the medial face and the center point of the lateral face.

Clause 38. The cushioning element of clause 37, wherein a width of the second pocket is measured from the web area to the center point of the medial face, a width of the third pocket is measured from the web area and the center point of the lateral face, a width of the fourth pocket is measured from the web area and the center point of the medial face, and a width of the fifth pocket is measured from the web area and the center point of the lateral face.

Clause 39. An article of footwear including the cushioning element of clause 34.

We claim:

1. A sole structure having a lateral side and a medial side opposite the lateral side, the sole structure comprising:

an outsole layer;

a first support element including first recesses;

a second support element coupled to the outsole layer and including second recesses; and a cushioning element disposed between the first support element and the second support element, the cushioning element including a plurality of pockets and a central pod, wherein a first subset of the plurality of pockets are disposed on the lateral side, a second subset of the plurality of pockets are disposed on the medial side, and a rear pocket of the plurality of pockets extends from the lateral side and the medial side, each of the first subset, the second subset, and the rear pocket being separated from the central pod by a web area, wherein the plurality of pockets are at least partially enclosed by the first recesses and the second recesses, and wherein the web area extends around an entirety of the central pod.

2. The sole structure of claim 1, wherein the cushioning element is a fluid-filled bladder.

3. The sole structure of claim 1, wherein a fluid of an interior of the cushioning element is at ambient pressure.

4. The sole structure of claim 1, wherein each of the plurality of pockets are fluidly separated from another of the plurality of pockets.

5. The sole structure of claim 1, wherein the central pod is fluidly separated from each of the plurality of pockets.

6. The sole structure of claim 1, wherein the first subset includes a front lateral pocket and a central lateral pocket.

7. The sole structure of claim 6, wherein the second subset includes a front medial pocket and a central medial pocket.

8. The sole structure of claim 7, wherein the rear pocket is disposed at a posterior most portion of the cushioning element.

9. The sole structure of claim 8, wherein the central lateral pocket is disposed between the rear pocket and the front lateral pocket.

10. The sole structure of claim 9, wherein the central medial pocket is disposed between the rear pocket and the front medial pocket.

11. The sole structure of claim 10, wherein the central pod is disposed between the rear pocket, the central medial pocket, the central lateral pocket, the front medial pocket, and the front lateral pocket.

12. The sole structure of claim 8, wherein the central medial pocket includes a dimension that is larger than the front medial pocket.

13. The sole structure of claim 8, wherein the central lateral pocket includes a dimension that is larger than the front lateral pocket.

14. The sole structure of claim 1, wherein the cushioning element includes a top surface and a bottom surface opposite the top surface, the bottom surface including a plurality of channels.

15. The sole structure of claim 14, wherein the first support element is coupled to the top surface of the cushioning element and the second support element is coupled to the bottom surface of the cushioning element.

16. The sole structure of claim 1, wherein the second support element coupled to the outsole forms at least a part of a ground-engaging surface of the sole structure.

17. The sole structure of claim 1, wherein a top surface of the outsole layer is in direct contact with a bottom surface of the first support element at an anterior position of the sole structure.

18. An article of footwear comprising:

the sole structure of claim 1; and an upper coupled to the sole structure.

19. The sole structure of claim 1, wherein the first support element includes an interface region, the interface region including:

the first recesses;

a plurality of mounds, wherein the first recesses and the plurality of mounds alternate with one another along a longitudinal axis of the sole structure to form an undulating path along a bottom surface of the first support element;

a receiving portion formed as a cavity in the bottom surface of the first support element; and a receptacle formed in the bottom surface of the first support element.

20. The sole structure of claim 1, wherein the second support element includes one or more traction elements disposed on a ground-engaging surface thereof.

* * * * *